US008655252B2

(12) United States Patent
Chiyoda

(10) Patent No.: US 8,655,252 B2
(45) Date of Patent: Feb. 18, 2014

(54) IMAGE CONTROL DEVICE

(75) Inventor: Yasuharu Chiyoda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 13/219,027

(22) Filed: Aug. 26, 2011

(65) Prior Publication Data

US 2012/0051816 A1 Mar. 1, 2012

(30) Foreign Application Priority Data

Aug. 31, 2010 (JP) ..... 2010-195190

(51) Int. Cl.
*G03G 15/20* (2006.01)

(52) U.S. Cl.
USPC ..... 399/341

(58) Field of Classification Search
USPC ..... 399/341
See application file for complete search history.

(56) References Cited

U.S. PATENT DOCUMENTS

2009/0263148 A1* 10/2009 Omata ..... 399/39

FOREIGN PATENT DOCUMENTS

JP 2002-318482 A 10/2002
JP 2009-282499 A 12/2009

* cited by examiner

*Primary Examiner* — David Gray
*Assistant Examiner* — Erika J Villaluna
(74) *Attorney, Agent, or Firm* — Fitzpatrick, Cella, Harper & Scinto

(57) ABSTRACT

An image control device for controlling an image forming portion which includes a clear toner image forming portion for forming a clear image on a color toner image fixed on a recording material and includes a fixing device for fixing the formed clear toner image on the recording material, includes a converting portion for converting an image data for designating a toner amount per unit area of the clear toner image at each pixel into an output data, wherein the image data is capable of providing a value which monotonically increases to a maximum from a minimum designating that the toner amount per unit area is zero and the output data is capable of providing a value which monotonically increases to a maximum from a minimum designating that the toner amount per unit area is larger than zero; and includes a controller for controlling, in accordance with the output data, formation of the clear toner image by the clear toner image forming means, by which a clear toner is placed even where the image data is zero.

6 Claims, 14 Drawing Sheets

IMAGE CONTROL DEVICE

FIELD OF THE INVENTION AND RELATED ART

The present invention relates to an image control device for controlling an image forming means for effecting partial adjustment of image glossiness by using a clear toner.

An image forming apparatus for forming an image by using a clear toner (also called as a transparent toner) in addition to a yellow toner, a magenta toner, a cyan toner, and a black toner as colored toner (also called as a color toner) has been conventionally proposed. This is attributable to an increasing market demand for enhancing the appearance of an output image by partly adjusting glossiness of the output image. Specifically, this demand is such that additional information in terms of gloss, such as a water mark, an eye-catcher, or a security mark, is desired to be embedded in a part of an image by partly placing a clear toner image on a color toner image. Japanese Laid-Open Patent Application (JP-A) 2002-318482 proposes use of such a method that a final image is formed by forming a color toner image on a recording material, once fixing the color toner image, forming a clear toner image on the color toner image, and then fixing the clear toner image. This is because a fixing performance of a fixing device exceeds its limit when both of the color toner image and the clear toner image are intended to be fixed simultaneously.

Further, JP-A 2009-282499 proposes the following method in order to prevent uneven glossiness occurring on a color toner image when the image glossiness is partly adjusted by using the clear toner. That is, the clear toner in a certain amount which is less than the amount in a clear image forming area is also applied (placed) on an area other than the clear image forming area.

When the clear toner image is partly formed and fixed after the color toner image is formed and fixed on the recording material by using the method of JP-A 2002-318482, the uneven glossiness with graininess can occur in a color toner image area in which the clear toner image is not formed. The occurrence of the uneven glossiness may be attributable to a small amount of air, which enters a fixing nip, interposed between a fixing roller and the fixed toner image to prevent contact between the fixing roller and the surface of the fixed toner image.

The method of JP-A 2009-282499 is directed to alleviate the uneven glossiness described above. However, according to a study of the present inventor, it was found out that the method of JP-A 2009-282499 is accompanied with the following problem.

That is, in the method of JP-A 2009-282499, the clear toner image is formed in advance in a small amount also in the area in which the clear toner image is not intended to be formed. Further, in the method of JP-A 2009-282499, in an area in which a pixel value of an image data for the clear toner image is not more than a certain value (e.g., 20% or less when 256 gradation levels are represented by percentage), the pixel value is uniformly increased up to the certain value.

In this case, in the area in which the pixel value of the image data for the clear toner image is not more than the certain value, the image data is not reflected on an image product to result in unnatural representation in some cases.

SUMMARY OF THE INVENTION

A principal object of the present invention is to provide an image control device capable of preventing an occurrence of uneven glossiness when image glossiness is partly adjusted by using a clear toner and capable of suppressing a lowering in effect of the partial adjustment of the image glossiness.

According to an aspect of the present invention, there is provided an image control device for controlling image forming means which includes clear toner image forming means for forming a clear image on a color toner image fixed on a recording material and includes fixing means for fixing the formed clear toner image on the recording material, the image control device, comprising:

converting means for converting an image data for designating a toner amount per unit area of the clear toner image at each pixel into an output data, wherein the image data is capable of providing a value which monotonically increases to a maximum from a minimum designating that the toner amount per unit area is zero and the output data is capable of providing a value which monotonically increases to a maximum from a minimum designating that the toner amount per unit area is larger than zero; and control means for controlling, in accordance with the output data, formation of the clear toner image by the clear toner image forming means, by which a clear toner is placed even where the image data is zero.

These and other objects, features and advantages of the present invention will become more apparent upon a consideration of the following description of the preferred embodiments of the present invention taken in conjunction with the accompanying drawings.

Figure 14:
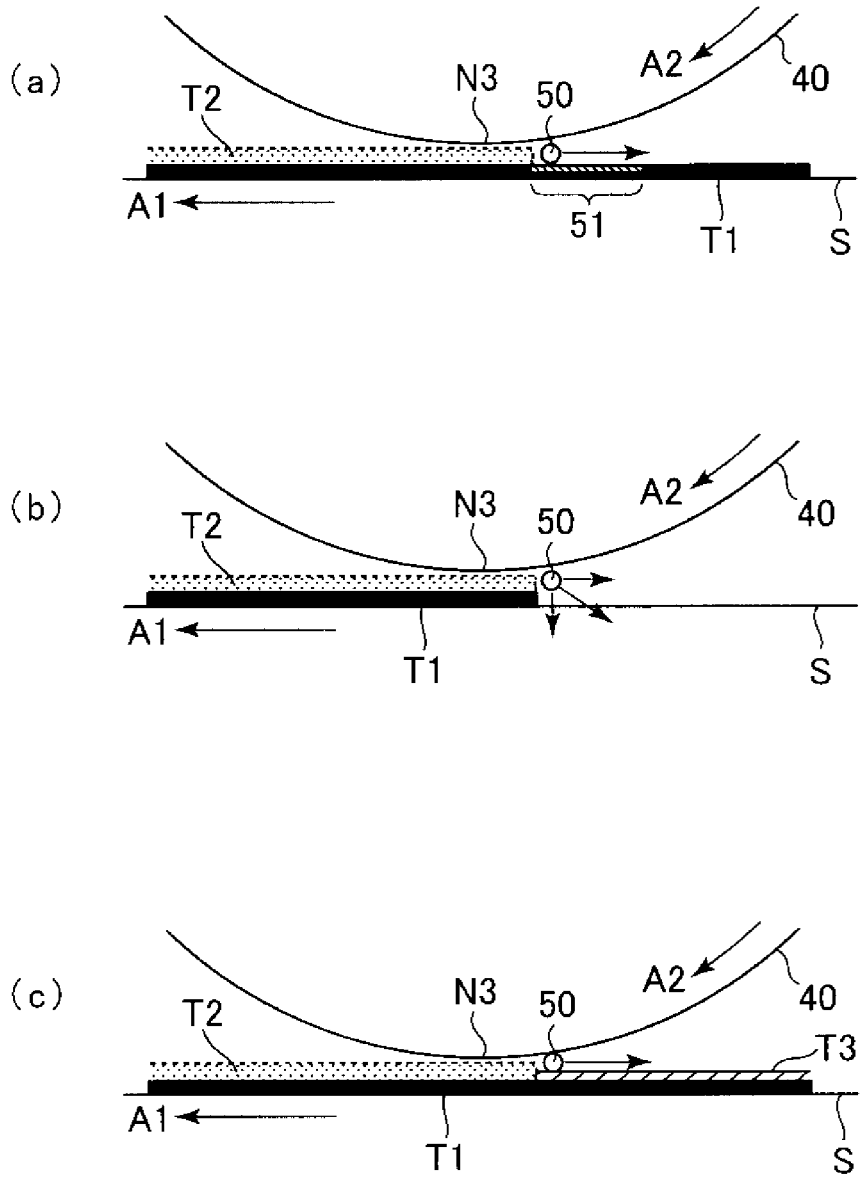

Parts (a) to (c) of FIG. 14 are schematic views for illustrating a conventional problem and a principle of a means for solving the problem.

DESCRIPTION OF THE PREFERRED EMBODIMENTS

The image control device according to the present invention will be described below with reference to the drawings.

Embodiment 1

1. General Structure and Operation of Image Forming Apparatus

Figure 1:
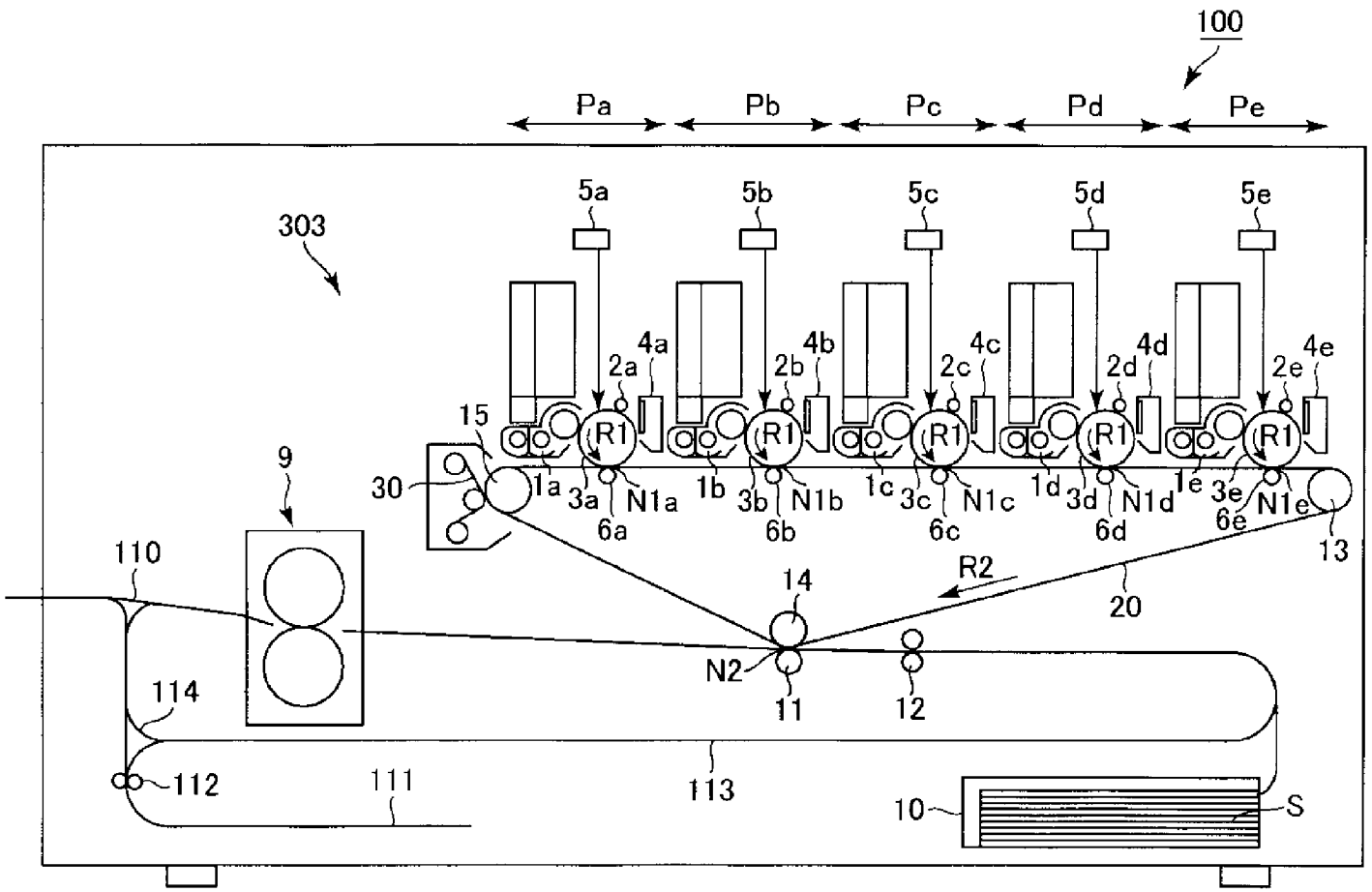
FIG. 1 is a schematic sectional view of an image forming apparatus in Embodiment 1 of the present invention.

First, a general structure and operation of an image forming apparatus in this embodiment will be described. FIG. 1 is a schematic sectional view for illustrating a structure of an image forming apparatus 100 in this embodiment. The image forming apparatus 100 is a multi-function machine which employs an electrophotographic type, a tandem type and an intermediary transfer type and which has functions of a copying machine, printer and a facsimile machine. Further, the image forming apparatus 100 is capable of forming a clear toner image at a part of a recording material S on which the color toner image is fixed.

Inside of the image forming apparatus 100, first to fifth image forming portions Pa, Pb, Pc, Pd and Pe are successively disposed. In the respective first to fifth image forming portions Pa to Pe, toner images are formed with different types of toners by an electrophotographic image forming process.

Incidentally, in this embodiment, constitutions and operations of the respective image forming portions Pa to Pe are substantially identical to each other except that the types of the toners used are different from each other. Therefore, in the case where there is no need to particularly discriminate the image forming portions and their constituent elements, suffixes a, b, c, d and e added to represent the elements for the respective image forming portions will be omitted from the following description and will be collectively described.

The image forming portion P includes a drum-like electrophotographic photosensitive member as an image bearing member, i.e., a photosensitive drum 3. On each photosensitive drum 3, the toner image is formed. Adjacently to each photosensitive drum 3, an intermediary transfer member 20 is provided. The toner image formed on each photosensitive drum 3 is primary-transferred onto the intermediary transfer member 20 at each primary transfer portion N1 and then is secondary-transferred onto the recording material S. The recording material S on which the toner image is transferred is heated and pressed by a fixing device 9, so that the toner image is fixed on the recording material S and then is discharged as a recording image to the outside of the image forming apparatus 100.

The photosensitive drum 3 is rotationally driven in an arrow R1 direction in FIG. 1. At the image forming portion P, around the photosensitive drum 3, the following means are provided. First, a charging roller 2 as a charging means is provided. Next, a developing device 1 as a developing means is provided. Next, a transfer roller 6 as a primary transfer means is provided. Next, a cleaner 4 as a cleaning means is provided. Further, at the image forming portion P, above the photosensitive drum 3 in FIG. 1, a laser scanner 5 as an exposure means is provided.

In the laser scanner 5, a light source device, a polygon mirror and the like are provided. The laser scanner 5 scans the surface of the photosensitive drum 3 with laser light emitted from the light source device while rotating the polygon mirror and defects light flux of the laser (scanning) light by a reflection mirror and then focuses the light flux on a generating line of the photosensitive drum 3 through fθ lens, thus effecting light exposure. As a result, an electrostatic latent image (electrostatic image) depending on an image signal is formed on the photosensitive drum 3.

In the developing devices 1*a*, 1*b*, 1*c*, 1*d* and 1*d*, as a developer, a yellow toner, a magenta toner, a cyan toner, a black toner and a clear toner are filled, respectively, in a predetermined amount. The developing devices 1*a* to 1*e* develop the electrostatic latent images on the photosensitive drums 3*a* to 3*e*, respectively, to form a yellow image, a magenta image, a cyan image, a black image and a clear image. To each developing device 1, a toner is timely supplied by a supplying device.

The intermediary transfer member 20 is formed with an endless belt (intermediary transfer belt) and is extended around a tension roller 13, a secondary transfer opposite roller 14 and a driving roller 15. The intermediary transfer member 20 is rotationally driven in an arrow R2 direction in FIG. 1 at the same peripheral speed as that of the photosensitive drum 3.

At an inner peripheral surface of the intermediary transfer member 20, the primary transfer roller 6 is disposed opposed to the associated photosensitive drum 3. Each primary transfer roller 6 is urged toward the associated photosensitive drum 3 to form the primary transfer portion (primary transfer nip) N1 where the photosensitive drum 3 contacts the intermediary transfer member 20. Further, at an outer peripheral surface of the intermediary transfer member 20, a secondary transfer roller 11 as a secondary transfer means is disposed opposed to the secondary transfer opposite roller 14. The secondary transfer roller 11 is urged toward the secondary transfer opposite roller 14 to form a secondary transfer portion (secondary transfer nip) N2 where the intermediary transfer member 20 contacts the secondary transfer roller 11. The secondary transfer roller 11 is shaft-supported substantially in parallel to the intermediary transfer member 20 and is provided in contact with the outer peripheral surface of the intermediary transfer member 20.

The toner image formed on the photosensitive drum 3 is primary-transferred onto the outer peripheral surface of the intermediary transfer member 20 in a process in which the toner image passes through the primary transfer portion N1. At this time, to the primary transfer roller 6, from a primary transfer power source as a voltage applying means, a primary transfer bias which is a DC voltage of an opposite polarity to a normal charge polarity of the toner is applied. The toner image on the photosensitive drum 3 is primary-transferred onto the intermediary transfer member 20 by an electric field formed in the primary transfer portion N1 by the primary transfer bias and pressure exerted between the photosensitive drum 3 and the intermediary transfer member 20.

The toner image transferred on the intermediary transfer member 20 is secondary-transferred onto the recording material S in a process in which the toner image passes through the secondary transfer portion N2. At this time, from a secondary transfer power source as the voltage applying means, a secondary transfer bias which is a DC voltage of the opposite polarity to the normal charge polarity of the toner is applied. The toner image on the intermediary transfer member 20 is secondary-transferred onto the recording material S by an electric field formed in the secondary transfer portion N2 by the secondary transfer bias and pressure exerted between the intermediary transfer member 20 and the recording material S.

The recording material S is fed from a recording material cassette 10 and passes through a registration roller 12 and a pre-transfer guide and then is sent to the secondary transfer portion N2 with predetermined timing. In synchronism with this timing, the secondary transfer bias is applied to the secondary transfer roller 11.

The toner (primary transfer residual toner) remaining on the photosensitive drum 3 after the primary transfer is ended is removed and collected by the cleaner 4. The cleaned photosensitive drum 3 is subjected to subsequent formation of the electrostatic latent image. Further, the toner (secondary transfer residual toner) and another foreign matter which remain on the intermediary transfer member 20 after the secondary transfer is ended is wiped with a cleaning web (nonwoven fabric) by bring the cleaning web into contact to the surface of the intermediary transfer member 20.

The recording material S on which the toner image is transferred is introduced into the fixing device 9. The toner image is fixed on the recording material S by applying heat and pressure to the recording material S by the fixing device 9.

As will be specifically described later, the image forming apparatus 100 is operable in "whole image forming mode", non-clear image forming mode" and "clear image forming mode" as image forming modes different in number of the types of the toner used for forming the toner image to be transferred onto the recording material S in one secondary transfer step. In the whole image forming mode, synthetic toner images to be superposedly transferred onto the intermediary transfer member 20 are formed by using all the first to fifth image forming portions Pa to Pe and then are collectively transferred onto the recording material S in a secondary transfer step. In the non-clear image forming mode, synthetic toner images to be superposedly transferred onto the intermediary transfer member 20 are formed by using the first to fifth image forming portions Pa to Pd and then are collectively transferred onto the recording material S in the secondary transfer step. In the clear image forming mode, the clear toner image is formed on the intermediary transfer member 20 by using the fifth image forming portion Pe and then is transferred onto the recording material S in the secondary transfer step.

Further, as will be specifically described later, the image forming apparatus 100 in this embodiment is operable in "1 pass mode" and "2 pass mode" as image forming modes different in number of steps in which the toner image is transferred onto one of the two surfaces of the recording material S. In the 1 pass mode, with respect to one surface of the recording material S, each of a toner image transferring step and a toner image fixing step is performed one time. In the 2 pass mode, with respect to one surface of the recording material S, after the toner image is transferred and fixed, another toner image is transferred and fixed on the fixed toner image. In the case of both-side (surface) image formation, with respect to each of the two surfaces of the recording material S, the image can be formed by the operation in the 1 pass mode or the 2 pass mode.

Hereinafter, in the 2 pass mode, with respect to one surface of the recording material S, an operation in which the toner image is first transferred and fixed is also referred to as "first layer image formation". Further, hereinafter, in the second pass mode, with respect to one surface of the recording material S, an operation in which the toner image is once transferred and fixed and then the toner image is transferred and fixed is referred to as "second layer image formation".

During one-side image formation, in the case where the 1 pass mode is set, the recording material S on which the toner image is fixed is discharged to the outside of the image forming apparatus 100 as a recording image-forming product without being introduced into a re-feeding path 113. On the other hand, during the one-side image formation, in the case where the 2 pass mode is set, the recording material S is introduced into a one-side feeding path 114 and then is introduced into the re-feeding path 113 without being turned upside down, so that the second layer image formation is effected.

In the case of the both-side image formation, after the toner image is fixed on the first surface by the fixing device 9, the recording material S is introduced into a reverse path 111 by a flapper 110. Thereafter, the recording material S is turned upside down by a reversing roller 112 and then is introduced into the re-feeding path (both-surface path) 113. Then, the recording material S passes again through the registration roller 12, the pre-transfer guide and the secondary transfer portion N2, so that the toner image is transferred onto the second surface of the recording material S and is fixed on the second surface by the fixing device 9.

During the both-side image formation, in the case where the 1 pass mode is set, e.g., the flapper 110 is switched during the above-described image formation of the second surface of the recording material S, so that the recording material S on which the toner image is fixed is discharged to the outside of the image forming apparatus 100 as the recording image-formed product. On the other hand, during the both-side image formation, in the case where the 2 pass mode is set with respect to the first surface, the recording material S is turned again upside down by the reverse roller 112 and is introduced into the re-feeding path 113, so that the second layer image formation on the first surface is executed. In the case where the 2 pass mode is set also with respect to the second surface, the recording material S is turned again upside down by the reverse roller 112 and is introduced into the re-feeding path 113, so that the second layer image formation on the second surface is executed.

2. Fixing Device

Figure 2:
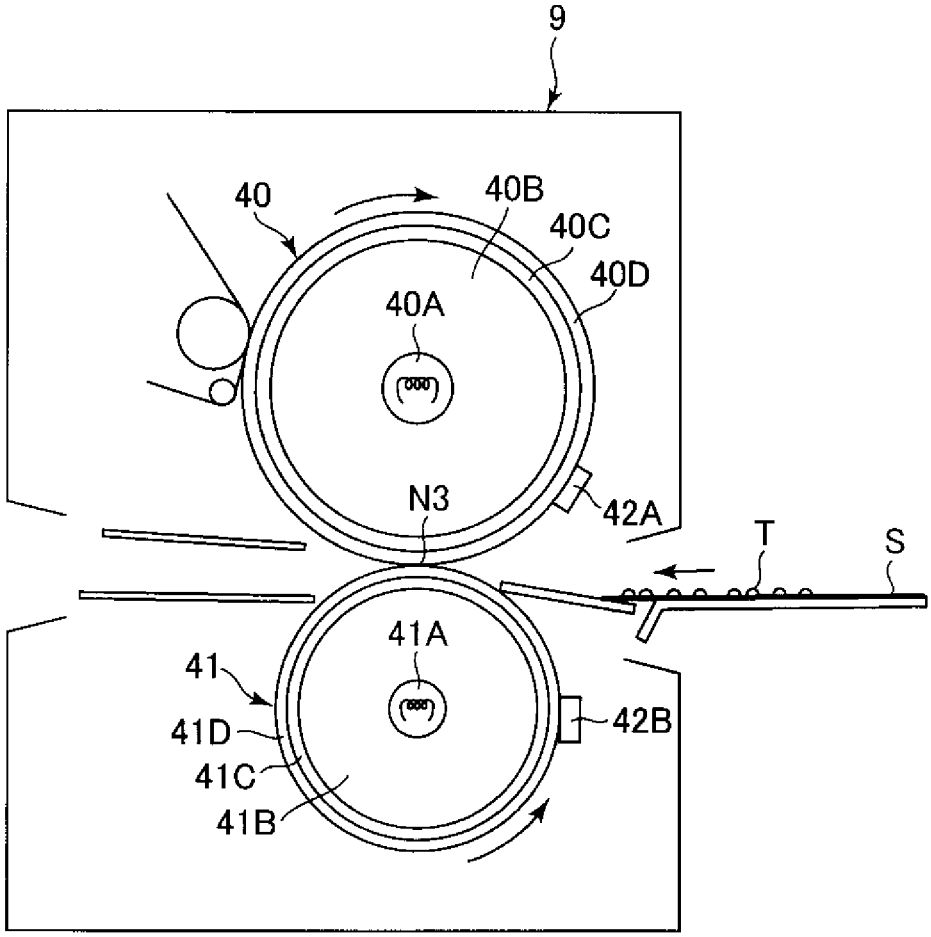
FIG. 2 is a schematic sectional view of a fixing device provided in the image forming apparatus in Embodiment 1 of the present invention.

FIG. 2 is a schematic sectional view of the fixing device 9. The fixing device 9 includes a 40 as a fixing member and a pressing roller 41 as a pressing member. The fixing roller 40 is a roller which internally includes a halogen heater 40A as a heat-generating member and which has an outer diameter of 80 mm. The pressing roller 41 is a roller which internally includes a halogen heater 41A as the heat-generating member and which has an outer diameter of 60 mm.

The fixing roller 40 includes a core metal 40B formed of aluminum, iron or the like in a cylindrical shape. Further, the fixing roller 40 includes an elastic layer 40C formed with a silicone rubber and positioned on the outer peripheral surface of the core metal 40B. Further, the fixing roller 40 includes a parting layer 40D which is formed with a tube of fluorine-containing resin such as PFA (tetrafluoroethylene-perfluoroalkylvinyl ether copolymer) or PTFA (polytetrafluoroethylene) and which coats the outer peripheral surface of the elastic layer 40C.

A surface temperature of the fixing roller 40 is detected by a thermistor 42A as a temperature detecting means. The detected surface temperature is inputted into a controller 302 (FIG. 3) of the image forming apparatus 100. Then, by the controller 302, the surface temperature of the fixing roller 40 is controlled as to be in a predetermined temperature range. Further, the controller 302 variably controls, depending on the type (basis weight) of the recording material S in order to meet various recording materials S, a target temperature within a range of 135° C.-200° C. and a fixing speed within a range of 100 mm/s-300 mm/s. As a result, with respect to melting and fixing the toner, optimum heat quantity can be controlled.

The pressing roller 41 includes a core metal 41B formed of aluminum, iron or the like in a cylindrical shape. Further, the pressing roller 41 includes an elastic layer 41C formed with a silicone rubber and positioned on the outer peripheral surface of the core metal 41B. Further, the pressing roller 41 includes a parting layer 41D which is formed with a tube of fluorine-containing resin such as PFA or PTFA and which coats the outer peripheral surface of the elastic layer 41C. The pressing roller 41 is urged by an urging spring as an urging member (means) and is press-contacted to the fixing roller 40 from below in FIG. 2. As a result, the fixing roller 40 and the pressing roller 41 press-contact each other with total pressure of about 784N (about 80 kgf). Further, the fixing roller 40 and the pressing roller 41 are disposed so as to be rotatable while being press-contacted to each other.

The surface temperature of the pressing roller 41 is, similarly as in the case of the fixing roller 40, detected by a thermistor 42B as a temperature detecting means and is controlled by the controller 302 (FIG. 3) depending on a detection result of the thermistor 42B.

When the fixing roller 40 is rotated in the clockwise direction in FIG. 2 by being driven by a motor as a driving source, the pressing roller 41 is rotated in the counterclockwise direction in FIG. 2 by the rotation of the fixing roller 40. The recording material S on which the toner image is formed is nip-conveyed between the fixing roller 40 and the pressing roller 41 in a fixing nip (fixing portion) N3 formed by contact between the fixing roller 40 and the pressing roller 41, thus being heated and pressed. As a result, the toner image T is fixed on the recording material S.

Incidentally, the heating means for the fixing member and/or the pressing member is not limited to the halogen heater. Further, as the fixing member and/or the pressing member, e.g., a belt-like urging member such as an endless belt may also be used.

3. Image Forming Mode

The image forming apparatus 100 in this embodiment in which the clear toner is used in addition to the color toners is operable in a plurality of image forming modes.

Table 1 appearing later shows combinations of a plurality of modes with respect to one of the two surfaces of the recording material S. In this embodiment, characteristic image control (hereinafter also referred to as invention control) is applied to the case where the toner image including at least the clear toner image is formed in the second layer image formation in the 2 pass mode. During the operation in the 1 pass mode, only one fixing operation is performed and therefore the invention control is not need. During the second layer image formation in the 2 pass mode, the invention control is used for preventing uneven glossiness occurring on the image formed during the first layer image formation.

3-1. 2 Pass Mode

One of objects of the second layer image formation is to provide a lower gloss texture than that of the image formed by the first layer image formation. That is, the first layer image fixed at first time on the recording material S is heated again by the surface layer of the fixing roller 40 of the fixing device 9 during the second layer image formation, so that the glossiness becomes higher than that during normal image formation. On the other hand, the second layer image passes through the fixing device 9 only during the second fixing and thus contacts the surface layer of the fixing roller 40 only one time, so that the glossiness becomes low relatively.

In this embodiment, a texture-providing treatment (processing) in which the image formation using the clear toner is principally effected as the second layer image formation to lower the glossiness of a transparent portion of the image formed with the clear toner and thus the texture is provided is used. However, also in the second layer image formation, the image formation using the color toner may also be effected. In this case, the amount of the color toner is replaced with the amount of the clear toner to determine the amount of application of the clear toner added in the second layer image formation.

3-2. Whole Image Forming Mode, Non-Clear Image Forming Mode and Clear Image Forming Mode In the image forming apparatus 100 in this embodiment, by instructions from the controller 302 (FIG. 3) of the image forming apparatus 100, control of the image forming means of the three types consisting of "whole image forming mode", "non-clear image forming mode" and "clear image forming mode" is effected. When data is outputted from a computer 500 (FIGS. 3 and 4) to the image forming apparatus 100, on the basis of information transmitted to the image forming apparatus 100 together with image information, the controller 302 judges that the image formation is effected by the operation in what mode selected from the above three modes.

3-2-1. Whole Image Forming Mode

The (maximum) five image forming portions Pa to Pe are operated, so that the toner images formed with the toners of the five types are collectively transferred onto the recording material S and then fixed on the recording material S.

That is, the yellow toner image, the magenta toner image, the cyan toner image, the black toner image and the clear toner image formed on the photosensitive drums 3*a* to 3*e* of the first to fifth image forming portions Pa to Pe are successively primary-transferred onto the intermediary transfer member 20 at the primary transfer portions N1*a* to N1*e*. As a result, the synthetic toner images corresponding to an objective image is formed by superposition transfer of the toner images of the five types. Incidentally, the synthetic toner images are formed while leaving a certain margin from four edges of the recording material S. In this embodiment, a leading end margin is about 2-3 mm. The synthetic toner images are collectively secondary-transferred onto the recording material S in the secondary transfer portion N2 in the above-described manner. Thereafter, the synthetic toner images are fixed on the recording material S by the fixing device 9.

3-2-2. Non-Clear Image Forming Mode

The formation of the toner images with the color toners (yellow, magenta, cyan and black) is effected at the first to fourth image forming portions Pa to Pd but the toner image formation with the clear toner at the fifth image forming portion Pe is not effected. The photosensitive drum 3*e* of the fifth image forming portion Pe is rotated similarly as in the case of the photosensitive drums 3*a* to 3*d* of the first to fourth image forming portions Pa to Pd but the clear toner image formation is not effected. For that reason, the primary transfer of the clear toner image onto the recording material S at the primary transfer portion N1*e* of the fifth image forming portion Pe is not performed. Other operations are substantially identical to those in the whole image forming mode.

3-2-3. Clear Image Forming Mode

Contrary to the non-clear image forming mode, the formation of the toner images with the color toners at the first to fourth image forming portions Pa to Pd is not effected but only the fifth image forming portion is operated to form the toner image with the clear toner. The photosensitive drums 3*a* to 3*d* of the first to fourth image forming portions Pa to Pd are rotated similarly as in the case of the photosensitive drum 3*e* of the fifth image forming portion Pe but the formation of the toner images for the respective color of yellow, magenta, cyan and black is not effected.

TABLE 1

| Mode | 1st layer*1 | 2nd layer*2 | Applicable range*3 |
|---|---|---|---|
| 1 pass | A | — | — |
| " | B | — | — |
| " | C | — | — |
| 2 pass | A | A | ○ |
| " | A | B | — |
| " | A | C | ○ |
| " | B | A | ○ |
| " | B | B | — |
| " | B | C | ○ |
| " | C | A | ○ |
| " | C | B | — |
| " | C | C | ○ |

*1"1st layer" represents the first layer image formation. "A" is the whole image forming mode. "B" is the non-clear image forming mode. "C" is the clear image forming mode.
*2"2nd layer" represents the second layer image formation. "—" represents that the second layer image formation is not effected. "A", "B" and "C" are the same as in those in the first layer image formation.
*3"Applicable range" represents a range in which the invention control (characteristic image control in the present invention) is applicable. "—" represents that the invention control is not applicable. "○" represents that the invention control is applicable.

The invention control is applied when the combination of modes in the first layer image formation and the second layer image formation is represented by "○". That is, the invention control is applied in the case where the operation in which on the recording material S on which the toner image is formed and fixed once, the toner image is formed and fixed (again) is performed. Further, the invention control is not applied in the case where the clear toner is not used in the second layer image formation.

Incidentally, for easy understanding, in this embodiment, the one-side image formation is effected by the operation in the 2 pass mode in which the first layer image formation is effected by the operation in the non-clear image forming mode (B) and the second layer image formation is effected by the operation in the clear image forming mode (C). This is also true for Embodiments 2 to 4.

4. Toner

The toner used in this embodiment will be described. In this embodiment, as a base material (a binder) for the color toners (colored toners), a polyester resin material was used. As a color toner manufacturing method, a pulverization method was used. As the toner manufacturing method, it is also possible to use a suspension polymerization method, an interfacial polymerization method, and a dispersion polymerization method. A toner component and the manufacturing method are not limited to those described above. As the base material for the clear toner (transparent toner), the same polyester resin material as that for the color toner was used. The clear toner was manufactured without mixing a color pigment, different from the case of the color toners.

As the base material (binder) for the color toners, the polyester resin material having a glass transition point (temperature) (Tg) of 45° C. to 60° C. is generally used. The clear toner is not necessarily transparent. For example, the clear toner used in this embodiment is white in an unfixed state. This is because the clear toner is pulverized so as to provide a particle size of about 5 μm to about 10 μm. As the surface of the clear toner pulverized in the particle size of about 5 μm to about 10 μm, light is scattered, so that transmitted or absorbed light is decreased in amount. For that reason, the clear toner looks white to human eyes.

The glass transition point (Tg) is not particularly limited. When the type or molecular weight of the resin material for the toner is changed, a melting property of the toner is changed. For that reason, when the toners in the same amount are fixed under the same fixing condition, different glossiness values are obtained. Specifically, the glossiness is liable to increase when the base material having a low glass transition point (i.e., a meltable base material) is used. Further, the glossiness is liable to lower when the base material having a high glass transition point (i.e., a less meltable base material) is used.

In this embodiment, the glass transition points of the color toners and the clear toner were substantially equal to each other. However, the glass transition point of the clear toner can also be higher or lower than that of the color toners.

Further, even in the case where the toners having the same glass transition point are used, e.g., when energy provided to the toner is increased by decreasing the fixing speed or by increasing the fixing temperature, the glossiness is liable to increase.

5. Image Data

The image data for forming the toner image with the color toner or the clear toner will be described.

Hereinafter, the color image data refers to the image data used for forming the color toner image on the recording material S. Further, the clear image data refers to image data used for forming the clear toner image on the recording material S.

The color image data is constituted by image data of four types including cyan image data, magenta image data, yellow image data, and black image data.

The cyan image data is data for designating an amount (per unit area) of the cyan toner image to be formed on the recording material S by the image forming apparatus 100. Similarly, the magenta image data, the yellow image data, and the black image data are data for designating corresponding toner amounts.

The image data for each of the colors are the same data and therefore description will be made by taking the cyan image data as an example.

In this embodiment, the cyan image data is constituted by data (a pixel value) corresponding to pixels necessary to form an image depending on a resolution (dot per inch) of the image forming apparatus 100. Further, in this embodiment, a data value corresponding to one pixel is represented by 8 bits. Values which can be represented by the 8 bits are 0 to 255. For that reason, by using the 8 bits, it is possible to represent 256 gradation levels. Thus, the cyan image data refers to data aggregate, of the pixel values (0 to 255) for representing a density for each of the pixels, corresponding to the pixels necessary to form the cyan image. For simplification, a maximum of 255 which can be represented by the 8 bit is expressed as 100%. The image forming apparatus 100 changes an amount of toner to be formed (placed) on the recording material S depending on an inputted value (0% to 100%). In this embodiment, when 100%–cyan image data as a pixel value corresponding to all the pixels is inputted in the image forming apparatus 100, the image forming apparatus 100 forms an image with the cyan toner in a weight of 0.5 g per 1 $cm^2$. Herein, the toner weight in the case where an image is formed in an area of 1 $cm^2$ is referred to as the amount per unit area of the toner.

Similarly as in the case of the color image data described above, the clear image data refers to data aggregate, of the values (0 to 255) for representing the density for each of the pixels, corresponding to the pixels necessary to form the clear image.

Incidentally, a maximum density and a maximum amount per unit area are determined depending on image design, a toner property, a fixing condition of the fixing device, the type of the recording material, and the like. For that reason, these factors are not limited to those described in this embodiment. Hereinafter, for simplification, the pixel value of image data for an image is represented by adding the pixel value of image data for a corresponding image at the same position. For example, when the pixel value of the cyan image data is 20% and a corresponding pixel value at the same position is 40%, the pixel value of the color image data is represented as 60%.

6. Process for Suppressing Amount Per Unit Area of Color Toner

The image forming apparatus 100 effects image formation on the basis of the inputted color image data. In this case, the image forming apparatus makes image correction such as so-called gamma correction so that a color (tone) of the inputted color image data coincides with a predetermined color (tone). The image forming apparatus 100 calculates the toner amount for each of pixels by using the corrected data. Then, by superposing the respective color toners, various colors are represented. In this case, theoretically, as color image data, an image data amount is 400% at the maximum (i.e., when each of image data amounts for yellow, magenta, cyan and black is 100%).

As described above, theoretically, a maximum of color image data for one pixel is 400%. However, in actual image formation, toners with the image data value of 400% are less used. This is because the controller 302 (FIG. 3) changes the maximum value of the color image data for one pixel to a range from 180% to 240% by executing a method such as UCR or OGCR.

UCR refers to Under Color Removal. When a color original is subjected to four color separation, at a portion where three colors of cyan, magenta and yellow overlap with each other, a gray component generates. UCR is a method such that the gray component is replaced with black (Bk) print and aims to decrease a total image data amount by replacing the gray component, having darkness (depth of color) equal to or more than a certain degree, with the black print.

GCR refers to Gray Component Replacement. In a color-separated image, dots having the same cyan/magenta/yellow ratio assume black or gray. By replacing the resultant portion with black, a dot ratio can be decreases, so that a total dot area ratio is lowered by GCR. By employing these processes (methods), it is possible to reduce the amount of toner consumed during the image formation.

7. Various Conditions Used in Image Formation

In this embodiment, a density of 1.8 for each of the color toners was obtained at the toner amount per unit area of 0.5 $mg/cm^2$ by using A2 gloss coated paper having a basis weight of 150 $g/m^2$ as the recording material S. This toner amount per unit area of 0.5 $mg/cm^2$ was taken as a maximum toner amount per unit area for one color.

During the color toner image formation, a process speed was 100 mm/sec and a control temperature (target temperature) was 160° C. for the fixing roller 40 and was 100° C. for the pressing roller 41.

During the clear toner image formation, the process speed was 300 mm/sec and the control temperature (target temperature) was 160° C. for the fixing roller 40 and was 100° C. for the pressing roller 41.

In this embodiment, as described above, as the clear toner, toner produced by using the polyester resin material as the base material, identical to that for the color toners, without mixing a color pigment is used. For that reason, the clear toner has the substantially same glass transition point (Tg) as that of the color toners.

However, the process speed during the clear toner image formation is higher than that during the color toner image formation, so that energy which can be provided to the clear toner is decreased. For that reason, even when the toners having the same glass transition point are used, the energy which can be provided to the clear toner is less than the energy which can be provided to the color toners. Therefore, there is a tendency that the glossiness at a portion where the clear toner image is formed is lower than the glossiness at a portion where the color toner images are formed. In this embodiment, in order that the clear toner image is matte compared with the color toner images, a clear toner-formed area is made matte by positively lowering the energy at the time of the fixation during the second layer image formation. Specifically, as an image forming condition in the second layer image formation, the process Speed is increased to 300 mm/sec to lower an amount of heat given by the fixation, so that the glossiness of the clear toner is suppressed at a low level.

Incidentally, even at the same process speed, based on a difference in total amount of heat applied to the toner, it is possible to provide the difference in glossiness. That is, there is a tendency that the glossiness of the color toner image subjected to the fixing two times is higher than that of the color toner image subjected to the fixing one time.

In this embodiment, the image forming condition was set as described above so that the glossiness at the clear toner-formed portion is low. Further, as described above, the base materials for the color toners and the clear toner are identical to each other so that the glossiness at the clear toner-formed portion is low. It is also possible to use, as the base material for the clear toner, a base material having the glass transition point lower than that of the base material for the color toners. In that case, the glossiness of the clear toner image which has been fixed once can be made higher than that of the color toner images which have been fixed twice.

8. Partial Adjustment of Image Glossiness

Next, an image forming operation when partial adjustment of the image glossiness is effected with the clear toner by effecting the operation in the 2 pass mode including the non-clear image forming mode for the first layer image formation and the clear image forming mode for the second layer image formation will be described. Hereinafter, this image forming operation is also referred to as a 2 pass mode operation.

When the 2 pass mode operation is selected, the controller 302 (FIG. 3) controls the image forming apparatus 100 so that the clear toner image is formed and is then fixed on the recording material S on which the color toner images have been formed and fixed. That is, the control 302 selects the 2 pass mode operation, the first layer image formation is effected by the operation in the non-clear image forming mode in which the color images are formed and fixed on the recording material and then the second layer image formation is effected by the operation in the clear image forming mode in which the clear image is formed and fixed on the recording material S. In this way, in the 2 pass mode operation, the image forming apparatus 100 outputs a product by executing the toner image formation and the image heating on one of the surfaces of the recording material S separately in plural times.

Specifically, first, by using the first to fourth image forming portions Pa to Pd, the first layer toner images with the color toners formed on the intermediary transfer member 20 are formed on the recording material S. The recording material S on which the color toner images are formed is guided into the fixing device 9. As a result, the color toner images are fixed on the recording material S.

Then, the recording material S, coming out of the fixing device 9, on which the first layer toner images are fixed is changed in route and passes through the one-side feeding path 114 to be guided to the re-feeding path 113 without being turned upside down.

Thereafter, the recording material S on which the first layer toner images are fixed passes through the registration roller 12 and the pre-transfer guide and is conveyed again to the secondary transfer portion N2.

Then, on the recording material S on which the first layer toner images are fixed, the second layer toner image formed with the clear toner on the intermediary transfer member 20 by the fifth image forming portion Pe is formed (transferred). The recording material S on which the clear toner image is formed is guided into the fixing device 9. As a result, the clear toner image is fixed on the recording material S.

The recording material S passing through the fixing nip N3 of the fixing device 9 passes straightly through the flapper 110 and is conveyed by a discharging roller (not shown), thus being discharged to the outside of the image forming apparatus 100.

As described above in the 2 pass mode operation, on a part of the color toner images fixed on the recording material S, the clear toner image is formed and heated to perform the partial adjustment of the image glossiness.

That is, the clear toner image is transferred and fixed on the recording material S, on which the images of the color toners have been transferred and fixed in the first layer image formation, in the second layer image formation in order to perform the partial adjustment of the image glossiness. That is, the clear toner is partly laminated and fixed in an image area of the recording material S to perform the partial adjustment of the image glossiness. For this purpose, as a toner concentration of the clear toner image, the toner amount per unit area providing a desired glossiness is set. Incidentally, it is not necessary that the maximum amount per unit area of the clear toner coincides with that of the color toners, so that the toner amount per unit area capable of providing a desired glossiness may be taken as the maximum amount per unit area of the clear toner.

Incidentally, in this embodiment, in the second layer image formation, only the clear toner image is formed as described above but in the second layer image formation, the color toner images may also be formed in addition to the clear toner image. As a result, the color toner images are fixed on the recording material S in the first layer image formation and then the clear toner image or the color toner images and the clear toner image are formed in the second layer image formation.

9. Operation of Controller

Figure 3:
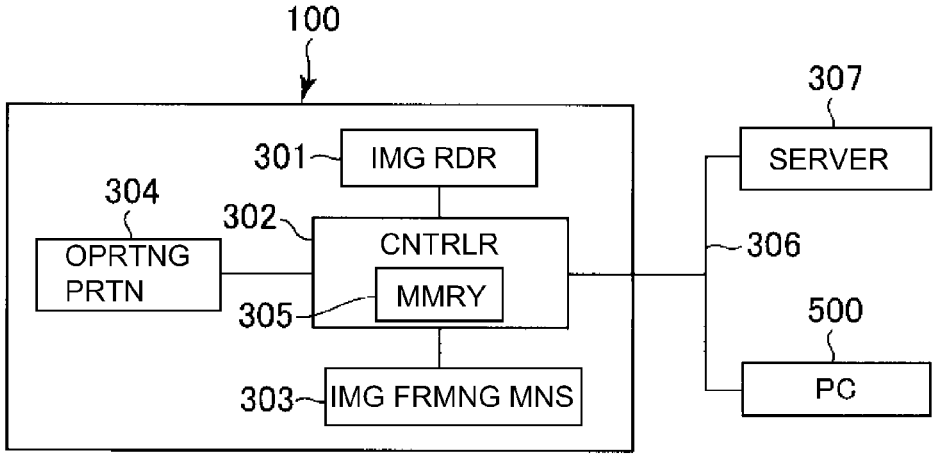
FIG. 3 is a schematic control block diagram of the image forming apparatus in Embodiment 1 of the present invention.

FIG. 3 is a schematic block diagram of the image forming apparatus 100.

The image forming apparatus 100 includes the controller 302, an image reading portion 301 connected to the controller 302, an image forming means 303, an operating portion 304 and the like. The controller 302 includes a memory 305 as a storing means. Further, the controller 302 performs input and output of data between itself and a server 307 or a computer 500 such as a PC (personal computer) via a data transmitting means 306.

In the case where the image forming apparatus 100 performs a printing operation, e.g., when the computer 500 receives an instruction to print image information of the server 307, the computer 500 separates this image information into a color image and a clear image and sends the data to the image forming apparatus 100. The controller 302 which receives the data temporarily stores the data in the memory 305. Then, the controller 302 judges whether or not the clear image formation should be effected. Further, the controller 302 converts, in the case where the clear image formation is effected, the image data by using a corresponding conversion table (look-up table (LUT)) depending on whether or not thin coating described later is set, and then provides a print instruction to the image forming means 303.

Further, the image forming apparatus 100 in this embodiment also can perform a copying operation and provides, when a copying operation instruction is inputted from the operating portion 304, an original reading instruction to the image reading portion 301. The image reading portion 301 sends the read image to the controller 302. The controller 302 having received the read data temporarily stores this data in the memory 305. Then, the controller 302 converts, similarly as in the case of the printing operation, the image data by using the corresponding conversion table (LUT) depending on the presence or absence of the clear image and the presence or absence of the thin coating setting, and sends the print instruction to the image forming means 303.

10. Uneven Glossiness (Glossiness Non-Uniformity)

The uneven glossiness occurring, in the above-described 2 pass mode operation, in an area in which the toner image is fixed in the first layer image formation but the clear toner image is not formed in the second layer image formation will be described.

As described above, when the clear toner image is partly formed and fixed after the clear toner images are formed and fixed on the recording material S, it has been known that image defect occurs in the color toner image area in which the clear toner image is not formed. This image defect can be observed by eyes as the uneven glossiness with graininess of about 0.1-3 mm.

This phenomenon would be considered to be attributable to the air (bubbles, gas) in a small amount which enters the fixing nip N3 and is nipped between the fixing roller 40 and the fixed toner image to prevent contact between the fixing roller 40 and the fixed toner image.

Further, parts (a) to (c) of FIG. 14 schematically illustrate a state in which the recording material S passes through the fixing nip N3 of the fixing device 9. In FIG. 14, T1 represents the fixed color toner image as the first layer and T2 represents an unfixed clear toner image as the second layer. When pressure and heat are applied to the fixing nip N3, at an upstream end portion of the fixing nip N3 with respect to movement directions A1 and A2 of the recording material S and the fixing roller 40, respectively, in the fixing nip N3, air 50 is generated from the unfixed clear toner image. This air 50 is sandwiched between the fixing roller 40 and the fixed color toner image T2, so that the uneven glossiness occurs in an area 51 of the fixed color toner image as the first layer prevented from the contact with the fixing roller 40 by the sandwiched air 50 ((a) of FIG. 14).

This air 50 is enclosed air at the time of pressing the smooth fixing roller 40 against the uneven surface of the toner images. More specifically, when the unfixed toner image is fixed, the air can escape from a gap between toner particles of the unfixed toner image so that there is no problem in a first fixing step. However, in a second fixing step, the image which is already fixed in the first fixing step is in a smooth state to same extent in the second fixing step and therefore it would be considered that the air cannot be escaped and thus the image defect is caused.

If the area 51 is an area in which the first layer color toner images are not formed, the generated air 50 can more easily, so that the air 50 can enter, e.g., fibers of paper as the recording material S and thus no problem occurs ((b) of FIG. 14).

JP-A 2009-282499 proposes the following control. That is, in the case where the clear toner is placed on a predetermined area (clear image area) as a part of the surface of the recording material on which the color toner image are fixed, the clear toner is placed on also at least a color toner image-fixed area of a toner image formable area excepting the clear image area. Further, the amount per unit area of the clear toner to be placed on an area, other than the clear image area, in which the clear toner is to be placed is controlled so as to be smaller than the amount per unit area of the clear toner to be placed. Herein, this control is referred to as thin coating. Further, the area, other than the clear image area, in which the clear toner is to be placed is referred to as a thin coating area.

Also by performing such thin coating, the generated air 50 can escape from the gap between toner particles of an unfixed clear toner layer T3 formed by the thin coating on the fixed color toner image T1 as the first layer when the unfixed clear toner layer T3 is present. Therefore, the air 50 can move without affecting fixability ((c) of FIG. 14).

11. Conventional Problem

The problem of the uneven glossiness when the glossiness difference on the image in the 2 pass mode operation is provided can be prevented by performing the thin coating. However, in the method of JP-A 2009-282499, during the second layer image formation, e.g., the pixel value of the clear image data is uniformly increased up to 20% in a range in which the color image data pixel value is 20% or less. In such conventional thin coating, it was found that the following problem occurs.

That is, the conventional thin coating results in the same representation in the range in which the clear image data pixel value is 20% or less during the second layer image formation. That is, in the range in which the clear image data pixel value during the second layer image formation is not more than a certain value (e.g., 20%), all the pixel values of the clear image data in the range are uniformly changed to the certain value (e.g., 20%), so that the data for the pixel values which are not more than the certain value cannot be reflected in a resulting product. Further, in some cases, the data results in unnatural representation.

12. Invention Control

In this embodiment, the clear toner is applied in a small amount (thin coating) in an area different from the area (clear image area) in which the clear toner image is intended to be formed in the second layer image formation. In this case, the control (invention control) for further lowering the glossiness in the area (clear image area) in which the clear toner image is intended to be formed in the second layer image formation is effected. That is, in this embodiment, the control such that the amount of the clear toner applied in the area (clear image area) in which the clear toner is intended to be formed in the second layer image formation is made larger than an originally intended amount in the clear image area. As a result, the glossiness difference between the clear image area and the area in which the clear toner is placed by the thin coating approaches the glossiness difference between the original clear image area in which the thin coating is not performed and another area (in which the color toner images are fixed in the first layer image formation).

That is, in this embodiment, the image forming apparatus 100 includes the clear toner image forming means for forming the contact toner image on the color toner images fixed on the recording material S. The image forming apparatus 100 further includes the fixing means for fixing the formed clear toner image on the recording material S. In this embodiment, the clear toner image forming means is constituted by the fifth image forming portion Pe, the intermediary transfer member 20, the secondary transfer roller 11 and the like. In this embodiment, the fixing means is constituted by the fixing device 9. The image forming means 303 including the clear toner image forming means and the fixing means is constituted by the image forming portions Pa to Pe, the intermediary transfer member 20, the secondary transfer roller 11, the fixing device 9 and other elements. Further, in this embodiment, the image control device for controlling the image forming means 303 is constituted by the controller 302. The image control device includes a converting means, for the thin coating the image data for designating the toner amount per unit area of each pixel of the clear toner image. The converting means for the thin coating converts an input data, capable of providing a value which gradually increases from a minimum designating that the toner amount per unit area is zero to a maximum, into an output data capable of providing a value which gradually increases from a minimum positioning that the toner amount per unit area is larger than zero to a maximum. Then, the image control device controls the thin coating operation in accordance with the image data converted by the converting means for the thin coating. That is, the image control device controls formation of the clear toner image by the clear toner image forming means so that the clear toner is placed, in the toner amount per unit area larger than zero designated by the minimum of the output data, also in the area of the color toner images in which the toner amount per unit area designated by the input data is zero. Typically, the converting means for the thin coating sets the toner amount per unit area so that the toner amount per unit area designated by the output data after the conversion is larger than that designated by the input data before the conversion in a total range (except for the maximum) from the minimum to the maximum of the input data. In this embodiment, the toner amount per unit area designated by the maximum of the output data is equal to that designated by the maximum of the input data.

Incidentally, in the case where the thin coating is not performed (in normal image formation), a normal converting means (for the normal image formation) is used. The normal converting means converts the input data, capable of providing a value which gradually increases from a minimum designating that the toner amount per unit area is zero to a maximum, into the output data capable of providing a value which gradually increases from a minimum designating that the toner amount per unit area is zero to a maximum.

In other words, in this embodiment, the image control device controls the clear toner image forming operation in the following manner. That is, the toner amount per unit area of the clear toner image formed in an arbitrary area of the surface of the recording material S is taken as A. A predetermined set value (threshold) of the toner amount per unit area is taken as B. Further, the toner amount per unit area of the clear toner image finally formed in the clear image area by the clear toner image formed means is taken as C. In this case, the image control device controls the toner amount per unit area so that the value C is equal to the value B when the value A is zero in the case where the value A is smaller than the value B and so that the value C is the value B or more when the value A is not zero in the case where the value A is smaller than the value B. Further, in the case where the value A is the value B or more, the image control device controls the toner amount per unit area so that the value C is the value A or more.

More specifically, the conversion table (LUT) as the converting means used in a conversion process of the clear image data during the thin coating is prepared by gradually increasing the output data relative to the input data in order to reproduce the difference in halftone image, thus increasing a converted value after the output. As a result, the amount of the clear toner placed by the thin coating is stepwisely corrected so as not to less the gradation level with respect to the original clear image data, so that it is possible to prevent a lowering in in-plane glossiness difference during the thin coating. This will be described more specifically below.

13. Relationship Between Toner Amount and Glossiness

In this embodiment, in the 2 pass mode operation, the glossiness is partly adjusted by using the clear toner in the second layer image formation. As described above, particularly in this embodiment, the clear toner image is not formed in an area (first area), in which the glossiness is enhanced, of the image area of the recording material S. On the other hand, the clear toner image is formed in an area (second area) different from the first area. As a result, the glossiness in the first area in which the clear toner image is not formed is high, and the glossiness in the second area in which the clear toner image is formed is low. Thus, by providing the difference in glossiness between the first area and the second area, the partial adjustment of the image glossiness is made.

The relationship between the toner amount and the glossiness under such a condition will be described.

First, an image is uniformly formed with a pixel value of 200% (toner amount per unit area: 1.0 mg/cm$^2$) of the color image data, on A2 gloss coated paper (basis weight: 150 g/m$^2$) with the glossiness of 25% as the recording material S. The glossiness when the color toner image is fixed on the recording material S under a condition including a target temperature of 160° C. and the process speed of 100 mm/s is 38% (60-degree glossiness measurement). Further, the glossiness at a portion where the once fixed color toner image is fixed again under a condition including the target temperature of 160° C. and the process speed of 300 mm/s is 50% (60-degree glossiness measurement).

Next, the image is uniformly formed with a pixel value of 200% (toner amount per unit area: 1.0 mg/cm$^2$) of the color image data, on the A2 gloss coated paper (basis weight: 150 g/m$^2$). The color toner image is fixed on the recording material S under a condition including a target temperature of 160° C. and the process speed of 100 mm/s. On this image, an image is uniformly formed with a pixel value of 100% (toner amount per unit area: 0.5 mg/cm$^2$) of the clear image data. The glossiness at a portion where the clear toner image is fixed on the recording material S under a condition including the target temperature of 160° C. and the process speed of 300 mm/s is 10% (60-degree glossiness measurement).

Incidentally, for the glossiness measurement, a handy gloss meter ("PG-1M", mfd. by Nippon Denshoku Industries Co., Ltd.) according to JIS Z 8741 (specular glossiness-measuring method) was used.

14. Clear Image Conversion Process

Figure 5:
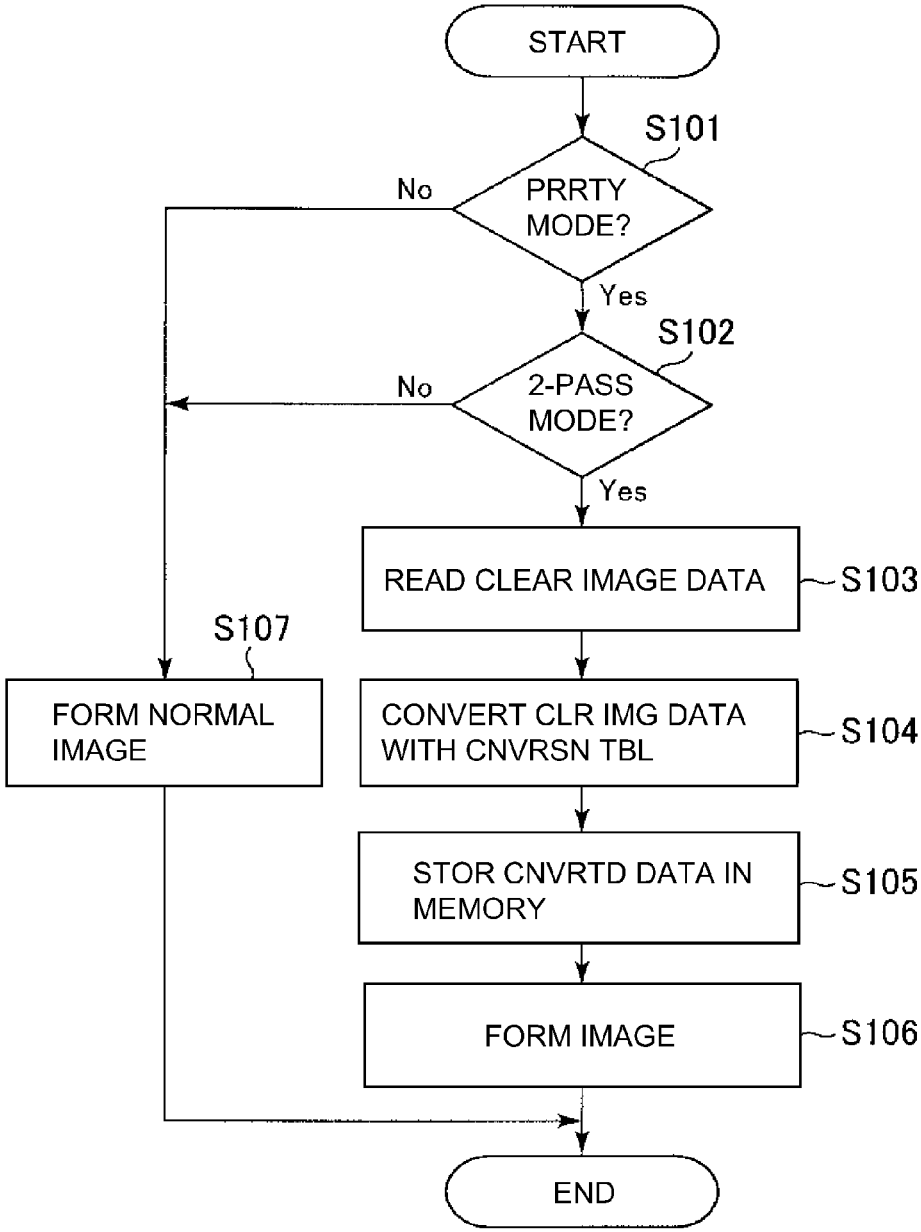
FIG. 5 is a schematic flow chart of an example of image formation control in accordance with the present invention.

FIG. 5 is a flow chart of image formation control by the controller 302 of the image forming apparatus 100.

The image forming apparatus 100 in this embodiment is operable in a glossiness difference priority mode and an image quality priority mode. In the glossiness difference priority mode, the normal image forming operation in which the thin coating is not effected is performed. In this glossiness difference priority mode, as described above, there is a possibility of an occurrence of the uneven glossiness. In the image quality priority mode, the thin coating is executed. The control in the case where the image quality priority mode is selected will be described more specifically below.

In this embodiment, in the 2 pass mode shown in FIG. 5, the operation in the mode in which the color image is formed and fixed on the recording material S and thereafter the clear image is formed and fixed on the color image. For example, the case where the color image and the clear image are simultaneously fixed and thereafter the clear image is fixed does not fall within the 2 pass mode operation in this embodiment.

The controller 302 judges, when an image formation instruction is provided, whether or not the image quality priority mode is set (S101) and then whether or not the 2 pass mode is set (S102). In the case where the image quality priority mode and the 2 pass mode are simultaneously set, the operation goes to processing for executing the thin coating (S103 to S106). In other cases, the normal image forming operation is performed (S107).

In the case where the thin coating is executed, the controller 302 first reads the clear image data (S103) and converts the read image data in accordance with a preset conversion table (S104). The controller 302 stores the converted image data in the memory 305 (S105). Thereafter, the controller 302 outputs the clear image data to the image forming means 303, so that the image forming operation is performed (S106).

Incidentally, also with respect to the color image data, as described above, the image converting step such as UCR or GCR is performed and then together with the print instruction, the converted color image data is sent to the image forming means 303, so that the image formation is effected but is omitted from description in FIG. 5 in order to obviate complicatedness.

More specifically, the controller 302 executes, in the operation in the image quality priority mode and the 2 pass mode, the following processing in order to solve the above-described conventional problem. That is, the clear image data pixel value is not constituted uniformly into the certain value but is converted in accordance with a conversion table (LUT) set so that the output data is stepwisely increased relative to the input data in the range of the pixel value from 0% to 10%. As a result, the clear image area in which the clear image with the pixel value of, e.g., 20% is originally intended to be outputted is not buried in the thin coating area in the case where the thin coating is executed, so that the image is formed in the amount of 20%+α (28% in an example of Table 2 appearing hereinafter). As a result, it becomes possible to realize delicate representation, based on the glossiness difference, by which the gradation level is stepwisely changed. The present invention is not limited to the case of the above-described pixel value of 20% but is capable of reproducing the image without losing information on the original difference.

The controller 302 sends, after the image converting step such as UCR or GCR as described above, the inputted color image data to the image forming means 303. Further, the controller 302 treats the inputted clear image data separately from the inputted color image data. For example, the clear image data has the pixel value for each pixel from 0 to 255 (0% to 100%). The controller 302 executes the clear image data converting processing with respect to the inputted clear image data. The controller 302 executes the clear image data converting processing in accordance with the conversion table (LUT) stored in the memory 305 in advance. The controller 302 stores the converted clear image data in the memory 305. Thereafter, the converted clear image data is set to the image forming means 303 together with the print instruction, so that the image formation is executed.

The clear image data converting processing will be further described. In this embodiment, for simplifying the description, as shown in FIG. 7, the conversion table was prepared so that a relationship between the input and the output shows a rectilinear proportionality.

When the input data of the clear image data pixel value is Ci (%), the converted output data is CO (%), and the pixel value for providing a minimum toner amount for achieving the effect of the thin coating is Cs (%), the clear image data was converted according to the following equation:

$$Co=Cs+((100-Cs)/100)\times Ci$$

Figure 7:
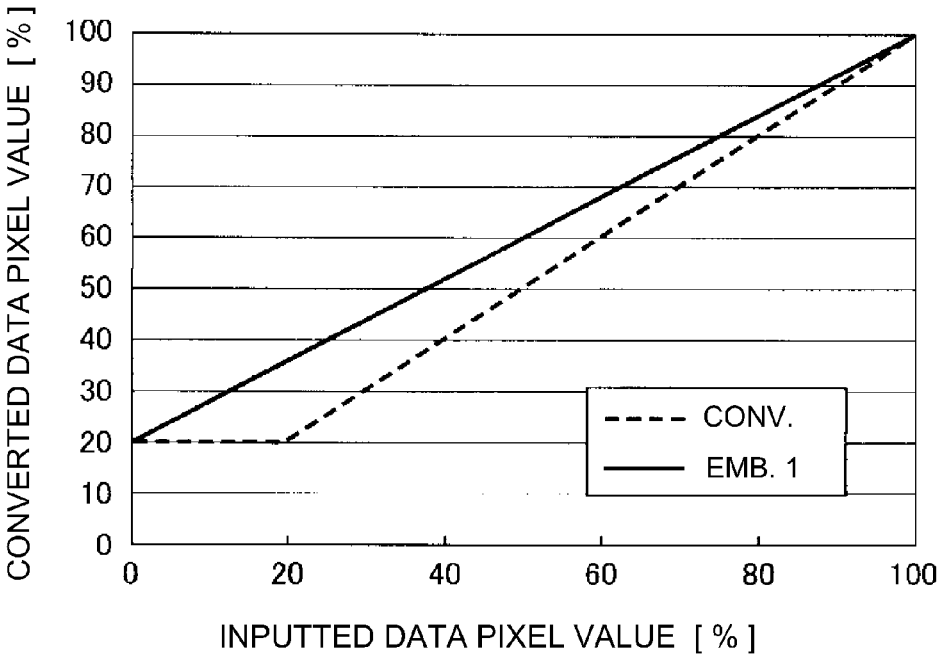
FIG. 7 is a graph showing an example of a conversion table of the clear image data used in Embodiment 1.

For example, when the pixel value Cs for providing the minimum toner amount for achieving the thin coating effect is 20%, the relationship shown in FIG. 7 (solid line) is obtained. Specifically, the output data Co is 20% when the input data is 0%, is 28% when the input data is 10%, and is 100% when the input data is 100%.

Incidentally, the conversion table is not limited to that represented by the above equation. It becomes possible to maintain the gradation level of the original clear image when the relationship is such that the outputted clear image data pixel value is increased with an increase in inputted clear image data pixel value with the pixel value, as a lower limit, for providing the minimum toner amount for achieving the thin coating effect.

Figure 8:
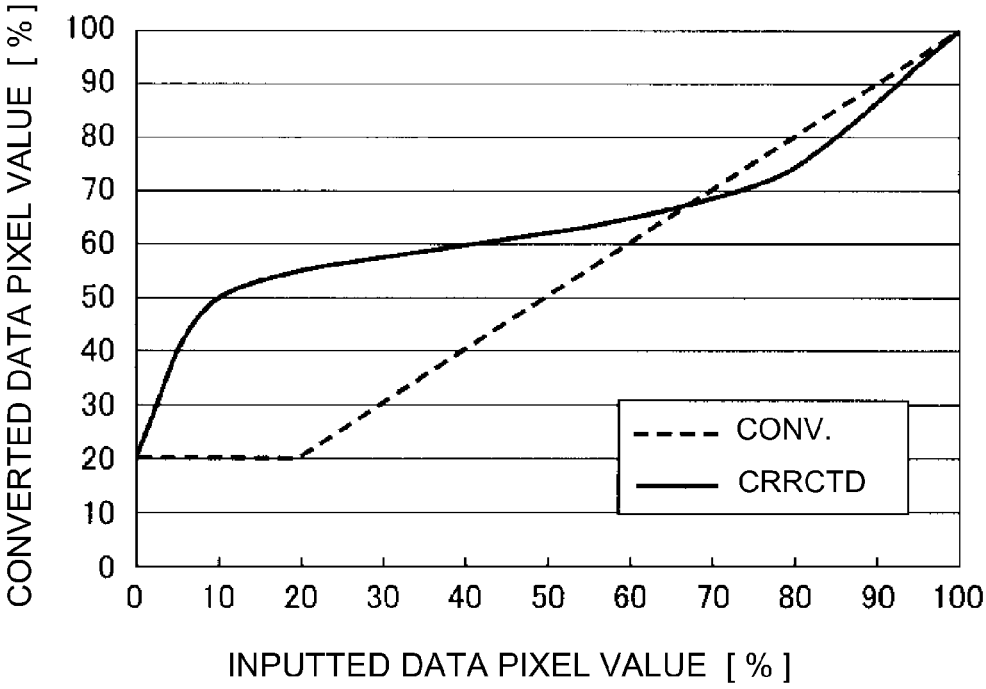
FIG. 8 is a graph showing another example of a conversion table to the clear image data used in Embodiment 1.

Further, e.g., it would also be considered that a method in which the relationship is judged by human eye observation from the relationship between the recording material S and the glossiness. As an example, the relationship, as the conversion table, between the input data and the output data calculated by subjective evaluation of the glossiness difference depending on the presence or absence of the setting of the thin coating with respect to a halftone gradation image of the clear image is shown in FIG. 8.

In this embodiment, in order to wisely meet various outputs, the conversion table as shown in FIG. 7 was used. However, in order to prepare a more natural output product depending on the recording material S or the image forming condition, it is possible to set an individual conversion table.

The pixel value Cs for providing the minimum toner amount for achieving the thin coating effect will be further described. It was confirmed through plural trails that the pixel value (minimum pixel value) for providing the minimum toner amount for achieving the thin coating effect varies depending on a condition. For example, the minimum pixel value is effected, in addition to the type of the recording material S, by a surface state, a basis weight and air permeability of the recording material S. Therefore, it becomes possible to realize representation close to an original target glossiness difference by setting the minimum pixel value depending on water content (ambient temperature or humidity) which affects on the amount of air generated from the toner image.

For example, in the case of the A2 gloss coated paper (basis weight: 150 g/m$^2$) used in this embodiment, when the thin coating with the clear toner amount corresponding to the pixel value of about 20% in an environment of 30° C. and 80% RH is not effected, the uneven glossiness occurred in some cases. On the other hand, when A2 gloss coated paper (basis weight: 256 g/m$^2$) with the glossiness of 45% was used in an environment of 20° C. and 30% RH, it was possible to prevent the occurrence of the uneven glossiness even by the thin coating with the clear toner amount corresponding to the pixel value of 10%.

That is, the above-described pixel value Cs, i.e., the value B is changeable. In other words, the minimum of the output data, for designating the toner designating the toner amount per unit area larger than zero, of the converting means for the thin coating is variable. For example, the pixel value Cs, i.e., the value B can be determined on the basis of a physical value of the recording material S on which the toner image to be formed, the toner amount per unit area of the color toner images as the first layer in the area in which the clear toner image as the second layer to be formed, or a correction value arbitrarily determined by the user.

As described above, the pixel value Cs (i.e., the value B) is liable to achieve the original effect of the partial adjustment of the image glossiness using the clear toner when it is as small as possible in the range in which the occurrence of the uneven glossiness can be prevented. The present invention is not limited thereto but a preferred result is obtained by setting the pixel value Cs (i.e., the value B) at 10% or more and 30% or less, generally at 15% or more and 25% or less, most typically at 20%.

15. Evaluation Test

An evaluation test with respect to the image glossiness difference showing the effect of this embodiment will be described.

First, samples with a single cyan image (amount per unit area: 0.5 mg/cm$^2$) to which a plurality of gradation levels were provided were prepared and subjected to subjective evaluation by observers. The samples were classified into 10 ranks ranging from "glossiness rank 1" as the lowest glossiness portion (100%–clear toner area) to "glossiness rank 10" as the highest glossiness portion (0%–clear toner area). The recording materials S used were the following four types.

A1 gloss coated paper (basis weight: 209 g/m$^2$)
A2 gloss coated paper (basis weight: 150 g/m$^2$)
Quality paper (basis weight: 80 g/m$^2$)
Recycled paper (basis weight: 60 g/m$^2$)

Figure 9:
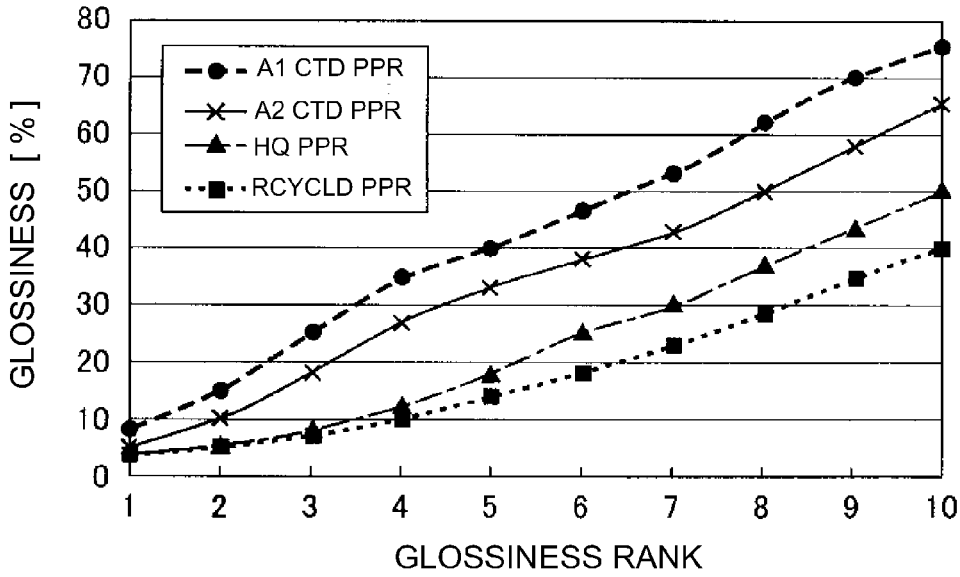
FIG. 9 is a graph showing a relationship between a glossiness rank and glossiness in subjective evaluation.

FIG. 9 is a plot of measured values of glossiness corresponding to determined glossiness ranks with respect to each of the recording materials S. As an index, in the case where the difference in glossiness rank is 1, the glossiness difference can be discriminated when the samples are adjacent to each other but it is generally difficult to discriminate their difference and the samples appear to be the same texture. However, when the difference in glossiness rank is 2 or more (when the glossiness difference is 10% or more), most of the observers were capable of recognizing that there was the glossiness difference.

Next, by using the above-prepared glossiness rank samples as a reference index, samples with various images such as a natural image, a human figure image and a geometric pattern were prepared and subjected to measurement of the glossiness at representative several points. An average of measured values was obtained to determine a corresponding glossiness rank of the reference index. The results are shown in Table 2 below. Incidentally, the representative several points were "no clear toner portion" (pixel value: 0%), "thin clear toner portion" (pixel value: 20%) and "thick clear toner portion" (pixel value: 70%). As the recording material S, the A2 gloss coated paper (basis weight: 150 g/m$^2$) was used.

TABLE 2

| Area*1 | CT*2 | NTC*3 | Conv*4 | E1*5 | E2*6 | E3*7 |
|---|---|---|---|---|---|---|
| NCT | 0% | 10 | 6 | 6 | 6 | 10 |
| TNCT | 20% | 6 | 6 | 5 | 3 | 7 |
| TKCT | 70% | 4 | 4 | 3 | 1 | 4 |

*1"Area" represents the representative area (portion). "NCT" is the no clear toner portion. "TNCT" is the thin clear toner portion. "TKCT" is the thick clear toner portion.
*2"CT" represents the pixel value for the clear toner.
*3"NTC" represents that the thin coating was not effected.
*4"Conv" represents the conventional embodiment.
*5"E1" represents Embodiment 1.
*6"E2" represents Embodiment 2.
*7"E3" represents Embodiment 3.

In Table 2, the glossiness ranks for "NTC" are results of the samples which were not subjected to the thin coating as in this embodiment and JP-A 2009-282499. In this case, the glossiness difference can be represented but as described above, the uneven glossiness can occur.

In Table 2, the glossiness ranks for "Conv" are results of the samples subjected to the thin coating with the uniform pixel value of 20%. In this case, the glossiness difference at the thick clear toner portion can be discriminated but the glossiness difference at the thin clear toner portion cannot be discriminated since the thin clear toner portion buried in the clear toner by the thin coating.

On the other hand, the glossiness ranks for "E1" are results of the samples subjected to the invention control in accordance with this embodiment (Embodiment 1). According to this embodiment, it is understood that the difference in glossiness rank is increased compared with the conventional embodiment. Thus, in this embodiment, compared with the conventional embodiment, it was able to be confirmed that it became possible to effect the representation with halftone glossiness.

Incidentally, in Table 2, the results of the samples subjected to the invention control in accordance with Embodiment 2 and Embodiment 3 are also shown. These results will be described in the associated embodiments.

As described above, according to this embodiment, in the case where the thin coating is effected to solve the problem of the uneven glossiness occurring when the partial adjustment of the image glossiness is made by using the clear toner, the decrease in glossiness which is originally desired by the user is suppressed and thus the original glossiness can be maintained. Therefore, according to this embodiment, the problem in the case where the partial adjustment of the image glossiness is made by using the clear toner can be solved without sacrificing the glossiness difference on the image. That is, according to this embodiment, it becomes possible to effect gloss representation desired by the user by using the glossiness difference on the basis of the difference in number of toner fixing operations in the image forming apparatus 100 while preventing the image defect caused when the toner image is formed on the recording material S on which the toner image is already fixed. Therefore, the present invention is very advantageous, e.g., when the representation such as water mark, eye catch or security mark is added by forming the clear toner image on the recording material S on which the color toner images are already fixed.

Embodiment 2

Another embodiment of the present invention will be described. In this embodiment, basic constitution and operation of the image forming apparatus are identical to those of the image forming apparatus in Embodiment 1. Therefore, constituent elements having the same or corresponding functions and constitutions as those of the image forming apparatus in Embodiment 1 are represented by the same reference numerals or symbols and will be omitted from detailed description.

The problem of the uneven glossiness when the glossiness difference on the image in the 2 pass mode operation is provided can be prevented by performing the thin coating. However, in the method of JP-A 2009-282499, during the second layer image formation, e.g., the pixel value of the clear image data is uniformly increased up to 20% in a range in which the color image data pixel value is 20% or less. In such conventional thin coating, it was found that the following problem occurs in addition to the problem described in Embodiment 1.

That is, the conventional thin coating results in loss of the halftone effect of the clear image during the second layer image formation. That is, at a high clear image density portion in the clear image area, it is possible to discriminate the glossiness from that in the area other than the clear image area. However, in the case where such an effect that the glossiness is gradually changed by providing the clear image in the clear image area with glossiness difference is intended to be achieved, the effect is less liable to be obtained or becomes unnatural in some instances. Specifically, in the case where the pixel value of the clear image exceeds about 70%, the glossiness difference can be discriminated but in the case of the halftone image for which the pixel value is below about 60%, the glossiness difference between the clear image area and the area other than the clear image area is not readily discriminated. For this reason, a boundary between these areas is eliminated, so that a clear pattern cannot be discriminated in some cases.

Referring to Table 2 again, in Embodiment 1, the glossiness difference between the no clear toner portion (pixel value: 0%) and the time clear toner portion (pixel value: 20%) is unclear.

In Embodiment 1, the maximum of the pixel value of the clear toner image is 100% but in this embodiment, the maximum of the pixel value is made larger than 100% in order to keep the glossiness different at a certain level, so that the clear toner amount per unit area is increased.

However, with an increase in clear toner amount per unit area, a degree of the lowering in glossiness is decreased and therefore the conversion processing with LUT may desirably be performed by gradually increasing a slope (difference) of the output data of the pixel value with respect to the input data of the pixel value.

That is, with respect to the relationship between the above-described values A and C, a relationship such that an increment (slope) of the value C is larger than that of the value A is created. In other words, the maximum of the value C is made larger than that of the value A. That is, the toner amount per unit area designated by the maximum of the output data of the converting means for the thin coating is larger than that designated by the maximum of the input data of the converting means for the thin coating.

Figure 10:
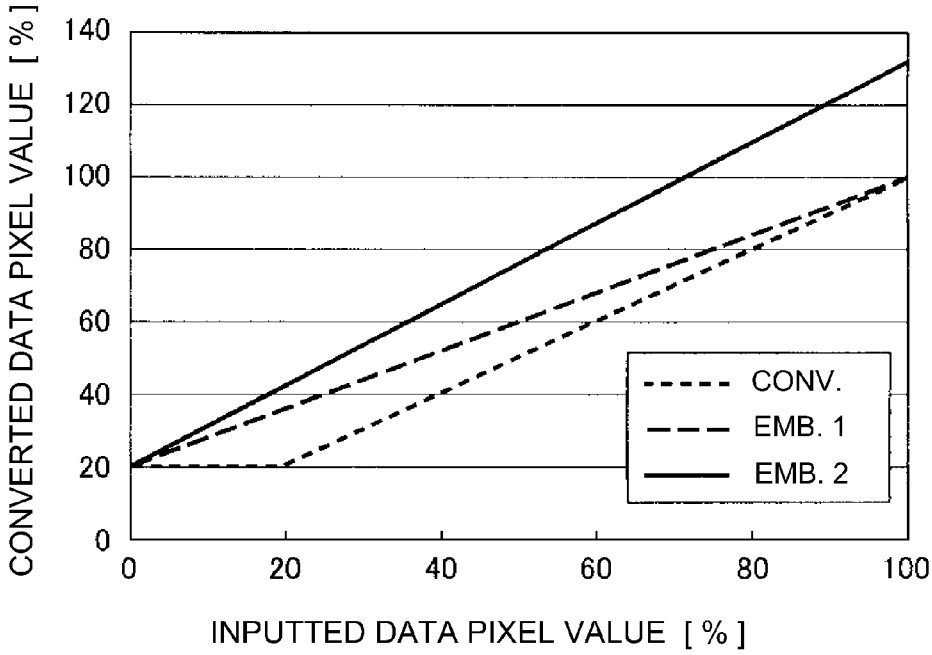
FIG. 10 is a graph showing an example of a conversion table of the clear image data used in Embodiments 2 and 3.

FIG. 10 shows an example of the conversion table in this embodiment. According to this conversion table, in the case where the pixel value of 0% (portion where no clear toner image is placed) of the clear image is converted to the pixel value of 20%, e.g., the portion with the original clear image pixel value of 40% is converted to the portion with the pixel value of 65% which is higher than the portion with the pixel value of 50% by 20% or more. The pixel value of 100% is converted to the pixel value of 130%, so that it is possible to effect representation close to that with the original glossiness difference.

Incidentally, in this embodiment, for simplification, the conversion formula is presented by a rectilinear line but as described above, the conversion table can be prepared in view of a degree of the change in glossiness.

Figure 6:
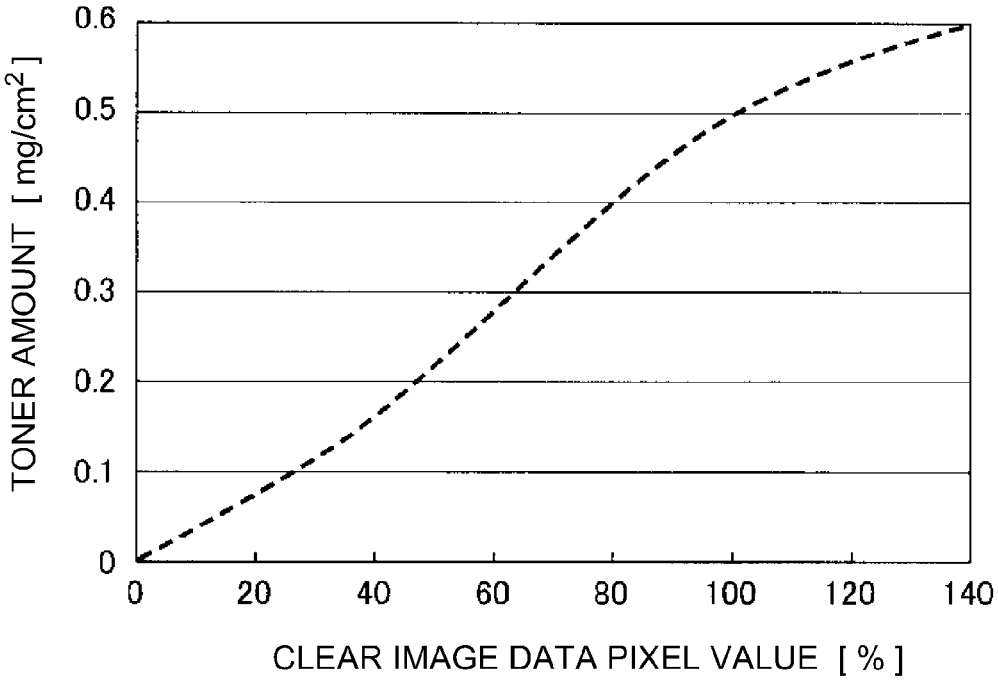
FIG. 6 is a graph showing an example of a relationship between a clear image data and a toner amount per unit area.

In this embodiment, the control is effected so as to provide the toner amount per unit area of about 0.5 mg/cm$^2$ in the case where the clear image pixel value is 100%. FIG. 6 shows a relationship between the pixel value and the toner amount per unit area on the photosensitive drum 3. For example, at the pixel value of 130%, on the photosensitive drum 3, the toner image is formed in the toner amount per unit area of about 0.58 mg/cm$^2$.

According to this embodiment, compared with Embodiment 1, the glossiness in the area in which the pixel value of the clear image data is large is also further lowered. As a result, by effecting the thin coating in the area in which the pixel value of the clear image data is small, the glossiness is lowered, so that it is possible to suppress the problem that the effects of the gradation representation and the glossiness difference are decreased.

According to the control in this embodiment, it is possible to prevent the occurrence of the uneven glossiness and in addition, as shown in Table 2, it is possible to easily discriminate the difference from the no clear toner portion (pixel value: 0%) even at the thin clear toner portion (pixel value: 20%). Further, at the thick clear toner portion (pixel value: 70%), a larger glossiness difference can be provided.

Embodiment 3

Another embodiment of the present invention will be described. In this embodiment, basic constitution and operation of the image forming apparatus are identical to those of the image forming apparatus in Embodiment 1. Therefore, constituent elements having the same or corresponding functions and constitutions as those of the image forming apparatus in Embodiment 1 are represented by the same reference numerals or symbols and will be omitted from detailed description.

The problem of the uneven glossiness when the glossiness difference on the image in the 2 pass mode operation is provided can be prevented by performing the thin coating. However, in the method of JP-A 2009-282499, during the second layer image formation, e.g., the pixel value of the clear image data is uniformly increased up to 20% in a range in which the color image data pixel value is 20% or less. In such conventional thin coating, it was found that the following problem occurs in addition to the problems described in Embodiments 1 and 2.

That is, the conventional thin coating results in a lowering in the effect of the clear image formed as the second layer. Specifically, in the conventional thin coating, the image formation is effected by uniformly increasing the clear image pixel value up to 20% also in the area other than the clear image area, so that the general gloss coated paper is lowered in glossiness as a whole when compared with the recording material S. As a result, the effect such that the glossiness difference is provided between the clear image area and the area other than the clear image area is reduced in some cases. In these cases, the glossiness difference from the high clear image density portion can be discriminated but when compared with the case where the thin coating is not effected, the effect pales.

In this embodiment, in addition to the same processing as in Embodiment 2, the fixing condition during the second layer image formation is changed. As a result, while maintaining the high gloss portion, the glossiness difference-providing effect by the clear toner is prevented from being largely impaired by the thin coating.

In this embodiment, in the case where the thin coating is effected, the fixing speed of the fixing device 9 during the second layer image formation is made slower than that in the case where the thin coating is not effected (during the first layer image formation). As a result, the fixability during the second layer image formation is improved. Further, in order to improve the fixability, not only the fixing speed is decreased but also the fixing temperature can be increased or the pressure can be increased. For example, the same effect as that obtained by decreasing the fixing speed can also be obtained by increasing the target (control) temperature of 160° C. for the fixing roller 20 to 200° C.

That is, during the second layer image formation in the case where the thin coating is effected, the fixing condition in the fixing step is set in the following manner. That is, compared with the case where the thin coating is not effected (during the first layer image formation), the fixing condition is set so that the conveyance speed (fixing speed) of the recording material S by the fixing device 9 is slower or the temperature (fixing temperature) of the fixing device 9 is higher. That is, the image control means further controls the fixing means so that compared with when the color toner images are fixed on the recording material, the recording material conveyance speed is slower or the temperature of the fixing means is higher when the clear toner image is fixed on the recording material.

Specifically, in this embodiment, in the case where the thin coating is effected, the fixing speed of the fixing device 9 during the second layer image formation is decreased from 100 mm/s in the case where the thin coating is not effected (during the first layer image formation) to 60 mm/s. Other conditions for the control are identical to those in Embodiment 2. In this embodiment, final heat quantity applied to the recording material S by the fixing roller 40 is increased, so that the glossiness lowered as a whole by the influence of the thin coating can be returned to the normal glossiness value.

According to the control in this embodiment, it is possible to prevent the occurrence of the uneven glossiness. In addition, as shown in Table 2, even in the case where the A2 gloss coated paper (basis weight: 150 g/m$^2$), the gloss feeling can be brought near to that in the case where the thin coating is not effected.

Incidentally, in this embodiment, in addition to the same processing as in Embodiment 2, the control in which the fixing speed is decreased was effected. However, in this embodiment, in addition to the same processing as in Embodiment 1, the control in which the fixing speed is decreased can also be effected. In this case, as described in Embodiment 2, the glossiness difference of the halftone clear image becomes somewhat unclear but compared with Embodiment 1, the effect such that the glossiness of the whole image can be brought close to that in the case where the thin coating is not effected can be obtained.

Embodiment 4

1. General Structure and Operation of Image Forming Apparatus

In Embodiments 1 to 3, the image forming apparatus 100 included only one image forming means for transferring and fixing the toner image on the recording material S. Therefore, in the case where the image formation is effected by the 2 pass mode operation with respect to one of the two surfaces of the recording material S, there was a need to convey, after the fixing step, the recording material again to the same transfer portion and the same fixing portion via the re-feeding path 113.

On the other hand, in this embodiment, the main assembly of the image forming apparatus 100 is divided into a color image forming apparatus (color image forming unit) including an image forming means for forming color images and a clear image forming apparatus (clear image forming unit) including an image forming means for forming the clear image.

Figure 11:
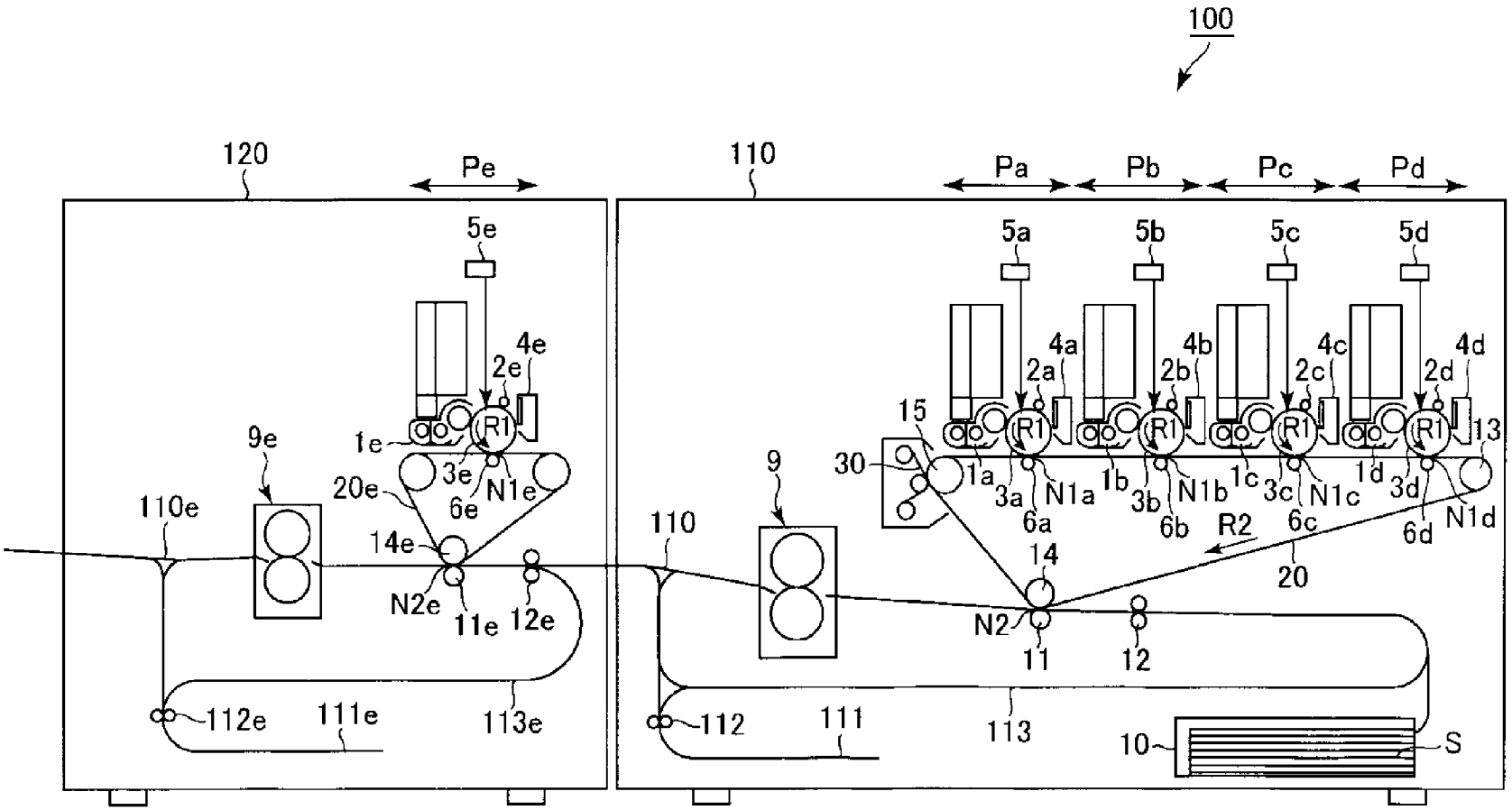
FIG. 11 is a schematic sectional view of an image forming apparatus in Embodiment 4 of the present invention.

FIG. 11 is a schematic sectional view of the image forming apparatus 100 in this embodiment. In this embodiment, the image forming apparatus 100 includes a color image forming apparatus 110 and a clear image forming apparatus 120. In the color image forming apparatus 110, the color toner images are transferred and fixed on the recording material S. In the clear image forming apparatus 120, the clear toner image is transferred and fixed on the recording material S.

Therefore, in the image forming apparatus 100 in this embodiment, in the 2 pass mode operation, the color toner images are formed and fixed on the recording material S as the first layer by the color image forming apparatus 110 and then the recording material S is conveyed to the clear image forming apparatus 120. Thereafter, the clear toner image is formed and fixed on the recording material as the second layer by the clear image forming apparatus 120.

The structure and operation of the color image forming apparatus 110 are similar to those of the image forming apparatus 100 shown in FIG. 1 except that the fifth image forming portion Pe is not provided. In the image forming apparatus 100 shown in FIG. 11, constituent elements having the same or corresponding functions and constitutions as those of the image forming apparatus 100 shown in FIG. 1 are represented by the same reference numerals and will be omitted from detailed description. In the color image forming apparatus 110, the respective color toner images formed on the photosensitive drums 3*a* to 3*d* of the first to fourth image forming portions Pa to Pd are primary-transferred onto the intermediary transfer member 20. The toner images are then secondary-transferred from the intermediary transfer member 20 onto the recording material S. Thereafter, the recording material S is heated and pressed by the fixing device 9, so that the toner images are fixed on the recording material S. Incidentally, the one-side feeding path 114 provided in the image forming apparatus of FIG. 1 for feeding the recording material S in the 2 pass mode operation to the re-feeding path without turning the recording material S upside down may be not provided in the color image forming apparatus 120.

Further, the structure and operation are common to the clear image forming apparatus 120 and the image forming apparatus 100 of FIG. 1 with respect to many constituent elements. However, the recording material S is conveyed from the color image forming apparatus 110 to the clear image forming apparatus 120 and therefore the recording material cassette 10 is not provided in the clear image forming apparatus 120. In the clear image forming apparatus 120, the constituent elements having the same or corresponding functions and constitutions as those provided in the color image forming apparatus 110 are represented by the same reference numerals or symbols to which the suffix e is added and will be omitted from detailed description. That is, in the clear image forming apparatus 120, as the image forming portion, only the image forming portion Pe for forming the clear toner image is provided. The clear toner image formed on the photosensitive drum 3*e* of the clear image forming portion Pe is primary-transferred onto the intermediary transfer member 20*e*. The clear toner image is then secondary-transferred from the intermediary transfer member 20*e* onto the surface of the recording material S, where the color toner images are fixed as the first layer, conveyed from the clear image forming apparatus 110 to the clear image forming apparatus 120. Thereafter, the recording material S is heated and pressed by the fixing device 9*e*, so that the clear toner image are fixed on the already-fixed color toner images on the recording material S. Incidentally, similarly as in the color image forming apparatus 110, the one-side feeding path 114 provided in the image forming apparatus 100 of FIG. 1 may be not provided in the clear image forming apparatus 120. Further, in the case where the fixing condition is changed during the second layer image formation similarly as in Embodiment 3, the fixing condition of the fixing device 9*e* of the clear image forming apparatus 120 can be set so that a driving speed during the fixing operation is different from that during the fixing operation by the fixing device 9 of the color image forming apparatus 110.

Here, when the image formation is effected by the operation in the 1 pass mode in the image forming apparatus 100 in this embodiment, the recording material S on which the color images are fixed is conveyed to the clear image forming apparatus 120 and is discharged to the outside of the image forming apparatus 100 as the recording image-formed product without forming the clear image. In this case, the temperature control condition of the fixing device 9*e* of the clear image forming apparatus 120 is changeable by a signal from a controller 312 (FIG. 12) and can be freely settable at the temperature, e.g., from normal temperature to 160° C.

2. Operation of Controller

Figure 12:
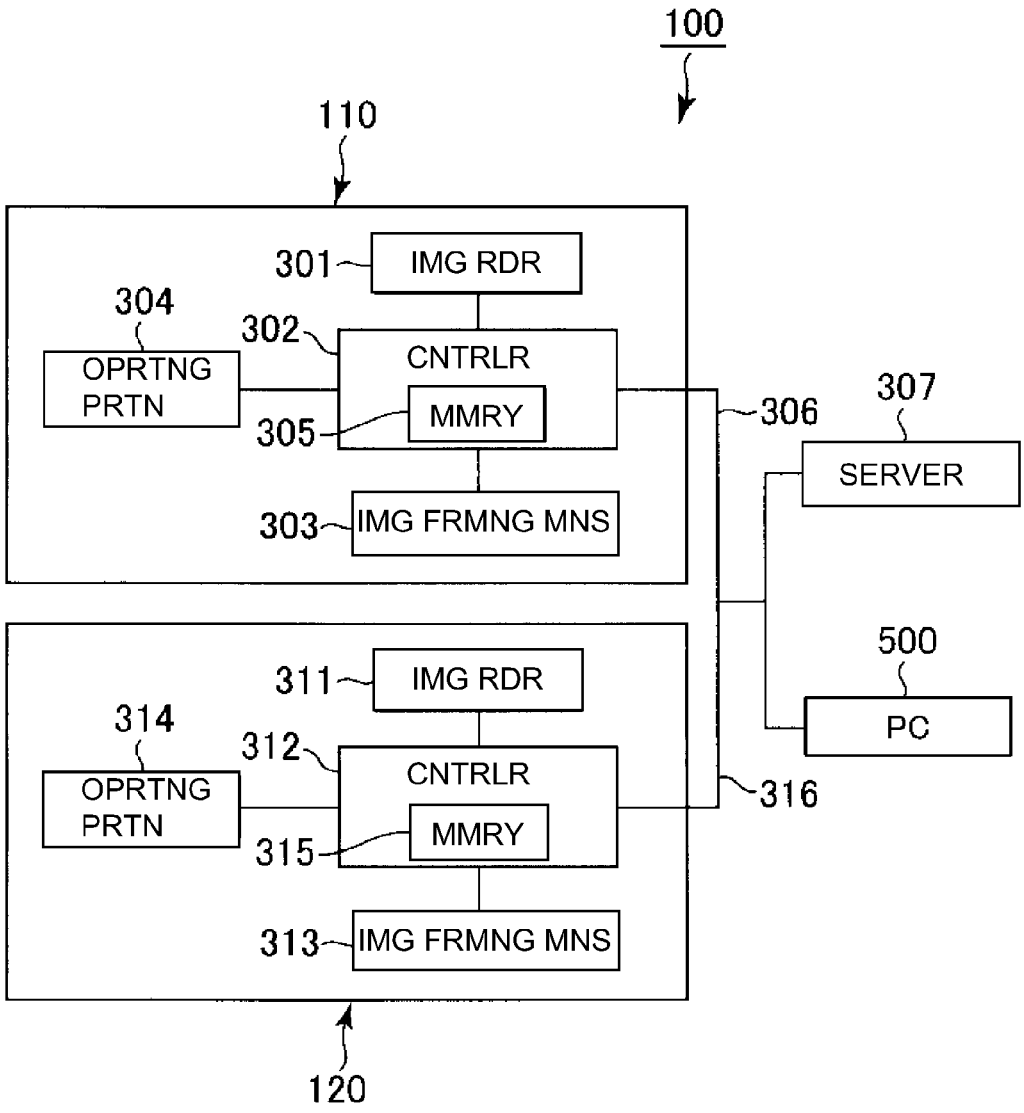
FIG. 12 is a schematic control block diagram of the image forming apparatus in Embodiment 4.

FIG. 12 is a schematic block diagram of control of the image forming apparatus 100 in this embodiment.

In Embodiments 1 to 3, by the controller 302 as the image control device, the judgment as the whether or not the thin coating should be executed and the conversion of the image data were performed. However, when the image data is inputted into the image forming apparatus 100, the image data conversion may be made in advance by the computer 500 and then the converted image data may be inputted into the image forming apparatus 100.

In this embodiment, as described above, the main assembly of the image forming apparatus 100 is divided into the color image forming apparatus 110 for forming the color toner images and the clear image forming apparatus 120 for forming the clear toner image. The color image forming apparatus 110 and the clear image forming apparatus 120 are controlled by the controllers 302 and 312, respectively, separately provided. Information is transmitted between the color image forming apparatus 110 and the clear image forming apparatus 120 and timing of the recording material S conveyance and timing of the image formation in the color image forming apparatus 110 and the clear image forming apparatus 120 are synchronized with each other.

Further, in this embodiment, in the case where the computer 500 judges that the thin coating should be effected, the processing of the inputted image data is performed by the computer 500 and then the processed image data is transmitted to each of the color image forming apparatus 110 and the clear image forming apparatus 120. In this case, the computer 500 discriminates the image pattern and converts the image data and then sends the converted image data to the color image forming apparatus 110 and the clear image forming apparatus 120. The thin coating itself may be the substantially same as that in Embodiment 1, 2 or 3 except that the second layer image formation is effected by the clear image forming apparatus 120.

Further, in the case where the fixing condition during the second layer image formation is changed similarly as in Embodiment 3, when the computer 500 judges that the thin coating should be effected, the computer 500 provides an instruction, to the clear image forming apparatus 120, that the fixing condition is changed.

The control by the image forming apparatus 100 in this embodiment will be further described with reference to FIG. 12. The color image forming apparatus 110 includes the controller 302, an image reading portion 301 connected to the controller 302, an image forming means 303, an operating portion 304 and the like. The controller 302 includes a memory 305 as a storing means. Further, the controller 302 performs input and output of data between itself and the clear image forming apparatus 120, a server 307 or the computer 500 such as a PC (personal computer) via the data transmitting means 316.

In the case where the image forming apparatus 100 performs a printing operation, e.g., when the computer 500 receives an instruction to print image information of the server 307, the computer 500 separates this image information into a color image and a clear image and sends the data to the image forming apparatus 100. The controller 302 which receives the data temporarily stores the data in the memory 305. Then, the controller 302

Similarly, the clear image forming apparatus 120 includes the controller 312, an image reading portion 311 connected to the controller 312, an image forming means 313, an operating portion 314 and the like. The controller 312 includes a memory 315 as a storing means. Further, the controller 312 performs input and output of data between itself and a server 307 or the computer 500 such as a PC (personal computer) via a data transmitting means 316.

In the case where the image forming apparatus 100 performs a printing operation, e.g., when the computer 500 receives an instruction to print image information of the server 307, the computer 500 separates this image information into a color image and a clear image and sends the data to the color image forming apparatus 110 and the clear image forming apparatus 120. The controller 302, of the color image forming apparatus 110, which receives the color image data temporarily stores the data in the memory 305. Then, the controller 302 provides the print instruction to the image forming means 303.

At this time, the clear image forming apparatus 120 is also operated in synchronism with the operation of the color image forming apparatus 110. The controller 312, of the clear image forming apparatus 120, which receives the clear image data temporarily stores the data in the memory 315. Then, the controller 312 provides the print instruction to the image forming means 313.

When image formation preparation of the color image forming apparatus 110 and the clear image forming apparatus 120 is completed, the printing is started, so that the color images and the clear image are successively formed on the recording material S. In this embodiment, the image control device is constituted by the computer 500, the controllers 302 and 312 and the like.

Incidentally, as described above, in this embodiment, after computation as image processing is performed in the computer 500, the image data after the computation is sent to the color image forming apparatus 110 and the clear image forming apparatus 120. However, the computation is not necessarily be performed by the computer 500 which outputs the image data. For example, after the image data is sent from the computer 500 to the color image forming apparatus 110 and the clear image forming apparatus 120, the controller 302 of the color image forming apparatus 110 can judge whether or not the thin coating should be executed. The controller 302 of the color image forming apparatus 110 can judge, from, e.g., the user setting or the color image data, whether or not the thin coating should be executed. Further, in the case where the thin coating is needed, the controller 302 can provide, to the clear image forming apparatus 120, an instruction to execute the thin coating. Then, in the case where the thin coating is executed, the controller 312 of the clear image forming apparatus 120 performs the converting processing in accordance with the conversion table shown in FIG. 7, 8 or 10 similarly as in Embodiment 1, 2 or 3.

Further, the image forming apparatus 100 in this embodiment may also be capable of performing a copying operation. When the copying operation is performed, as described above, the color image forming apparatus 100 judges whether or not the thin coating should be executed. In the case where the thin coating is needed, the converting processing of the clear image data can be performed by the clear image forming apparatus 120.

For example, when a copying operation instruction is inputted from the operating portion 304 of the color image forming apparatus 110, an original reading instruction to the image reading portion 301. The image reading portion 301 sends the read image to the controller 302. The controller 302 having received the read data temporarily stores this data in the memory 305. Then, the controller 302 images whether or not the thin coating should be executed. In the case where the thin coating is needed, the controller 302 provides a thin coating execution instruction to the clear image forming apparatus 120. In the case where the thin coating is executed, the controller 312 of the clear image forming apparatus 120 converts the clear image data in accordance with the conversion table and provides the print instruction to the image forming means 313. Alternatively, in this embodiment, the clear image forming apparatus 120 is also provided with the image reading portion 311. Therefore, by using the image reading portion 311, the data read at the clear image forming apparatus 120 side is converted into a single color data, so that the color images and the clear image can also be formed. Also in this case, when the setting of the thin coating is made, the image data can be converted in accordance with the conversion table by the controller 312 of the clear image forming apparatus 120.

Figure 13:
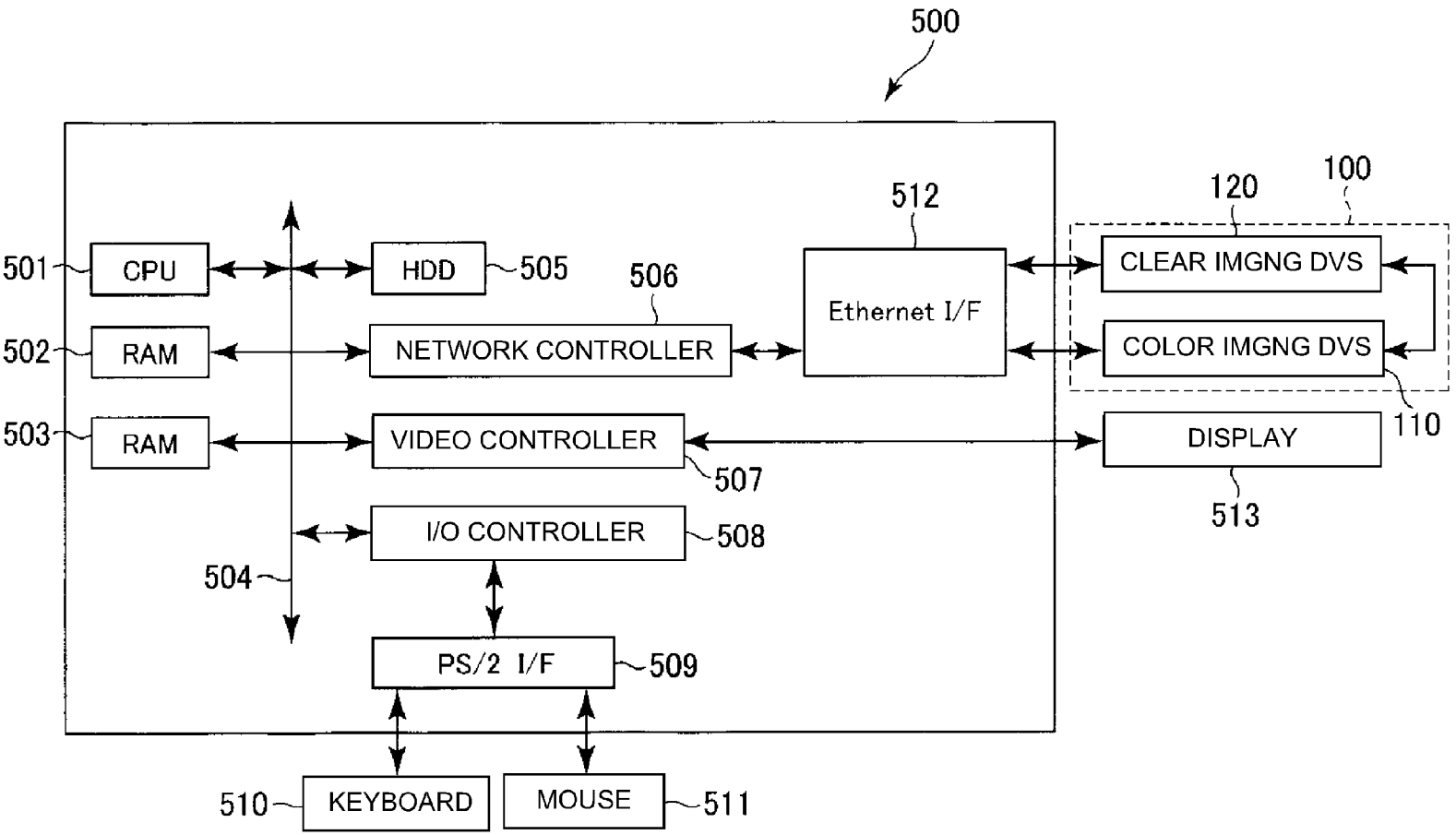
FIG. 13 is a schematic block diagram showing a hardware structure of a PC capable of constituting an image forming system together with the image forming apparatus in Embodiment 4.

Here, with reference to FIG. 13, the computer 500 will be further described. FIG. 13 is a block diagram showing a hardware configuration of the computer 500 such as the PC as information processing device.

The computer 500 is connected with the image forming apparatus 100 (the color image forming apparatus 110, the clear image forming apparatus 120) to constitute an image forming system. In this embodiment, the computer 500 and the image forming apparatus 100 are communicatably connected with each other through an Ethernet (trade name) I/F (interface) 512. The computer 500 is an external terminal capable of sending print job (instruction) to the image forming apparatus 100. For that purpose, it is also possible to use other terminals capable of sending the print job to an MFP (multifunction peripheral) as an alternative to the computer 500. For example, it is possible to use portable information terminals such as a WS (work station) and a PDA (personal digital assistant).

In the computer 500, a CPU (central processing unit) 501, an RAM (random access memory) 502, and an ROM (read only memory) 503 are connected to a bus 504. Similarly, a HDD 505, a network controller 506, a video controller 507, and an I/O (input/output) controller 508 are connected to the bus 504. The various units connected to the bus 504 are communicatable with each other through the bus 504. The CPU 501 executes a program, e.g., stored in the ROM 503 by expanding the program in the RAM 502. Further, the CPU 501 sends control instructions and the like to the HDD 505, the network controller 506, the video controller 507, and the I/O controller 508 through the bus 504. Further, the CPU 501 receives signals for indicating states and data such as image data from the HDD 505, the network controller 506, the video controller 507, and the I/O controller 508 through the bus 504. Thus, the CPU 501 is capable of controlling the various units constituting the computer 500.

The computer 500 is connected with the image forming apparatus 100 through an ethernet I/F 512. In the case where the computer 500 communicates with the image forming apparatus 100 through the ethernet I/F 512, a communication path is not limited to that in a LAN (local area network) but may also be that through the Internet. Further, to the computer 500, a keyboard 510 and a mouse 511, as an input device, are connected through a PS2 I/F 509. Further, to the computer 500, a display 513 as a displaying means is connected.

In this embodiment, the CPU 501 controls various pieces of hardware constituting the computer 500 in accordance with an OS (operating system) which is basic software installed in the HDD 505. As a result, the user can cause the computer 500 to execute a desired operation by manipulating a GUI (graphical user interface) without concern for the hardware constituting the computer 500. Further, the user is capable of sending the print job from an application program, which has been installed in the HDD 505 and is running under the OS, to the external image forming apparatus 100. When the print job is sent to the image forming apparatus 100, a control method varies depending on the kind of the image forming apparatus 100. For that reason, the computer 500 produces control instructions depending on the image forming apparatus 100 by using a driver program corresponding to the kind of the image forming apparatus 100. The driver program installed in the HDD 505 is capable of producing the control instructions depending on the connected peripheral equipment by being incorporated in a part of the OS. In this embodiment, in the computer 500, a program for executing the conversion of the clear image data is installed in the HDD 505. In this embodiment, the clear image data conversion or the like is performed by the driver program installed in the HDD 505.

Figure 4:
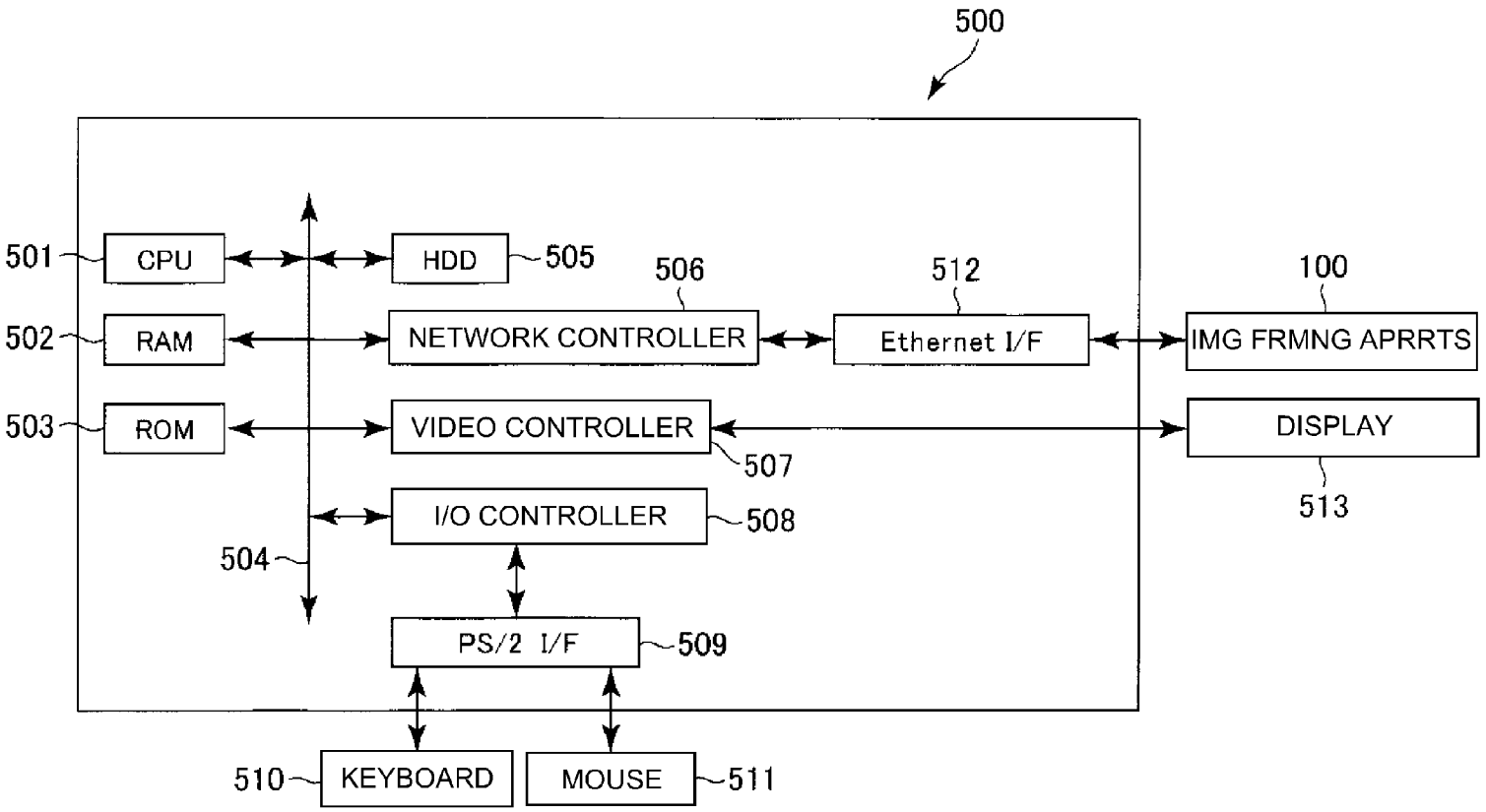
FIG. 4 is a schematic block diagram showing a hardware structure of a personal computer (PC) capable of constituting an image forming system together with the image forming apparatus in Embodiment 1 of the present invention.

Incidentally, as in this embodiment, the constitution for effecting the judgment as to whether or not the thin coating should be executed and the constitution for performing the image data conversion can also be applied to the case where the present invention is applied to the image forming apparatus 100 as described in Embodiments 1 to 3 with reference to FIG. 1, FIG. 4 is a block diagram showing an example in which the computer 500 having the same hardware configuration as that described above is connected with the image forming apparatus 100 in Embodiments 1 to 3.

Specifically, in this example, the image data inputted into the computer 500 for outputting the image data to the image forming apparatus 100 is stored in the internal RAM 502. When the user provides the print instruction via the keyboard 510, the mouse 511 or the like, the CPU 501 judges whether or not the image data stored in the RAM 502 in the computer 500 should be subjected to the thin coating. A criterion for this judgment is pursuant to a mode set in advance by the user.

Also with reference to FIG. 5, the CPU 501 judges, when an image formation instruction is provided, whether or not the image quality priority mode is set (S101) and then whether or not the 2 pass mode is set (S102). In the case where the image quality priority mode and the 2 pass mode are simultaneously set, the operation goes to processing for executing the thin coating (S103 to S106). In other cases, the normal image forming operation is performed (S107).

In the case where the thin coating is executed, the CPU 501 first reads the clear image data (S103) and converts the read image data in accordance with a preset conversion table (S104). The CPU 501 stores the converted image data in the RAM 502 (S105). Thereafter, the CPU 501 outputs the color image data to the color image forming apparatus 110 and outputs the clear image data to the clear image forming apparatus 120, so that the image forming operation is performed (S106). In this case, when the fixing condition during the second layer image formation is changed similarly as in Embodiment 3, an instruction to improve the fixability is provided to the clear image forming apparatus 120.

As described above, also in the case where the image forming apparatus 100 is constituted by the color image forming apparatus 110 and the clear image forming apparatus 120, the effects similar to those in Embodiments 1 to 3 can be achieved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195190/2010 filed Aug. 31, 2010, which is hereby incorporated by reference.

What is claimed is:

1. A controlling apparatus for controlling a transparent toner image forming apparatus which forms a transparent toner image on a color toner image fixed on a sheet and then heat-fixes the transparent toner image on the sheet, said controlling apparatus comprising:

an information obtaining portion configured to obtain information corresponding to (i) a gloss-adjustment area, including a first part and a second part, where a gloss of the color toner image on the sheet is to be partially adjusted, and (ii) a transparent toner amount per unit area in the gloss-adjustment area; and an image data generating portion configured to generate image data for forming the transparent toner image based on the obtained information;

wherein in a case that the transparent toner amount per unit area in the gloss-adjustment area based on the obtained information is not larger than a lower limit amount, said image data generating portion generates the image data so that the transparent toner amount per unit area in an area excluding the gloss-adjustment area within an image formable area of the sheet is a predetermined amount, and so that the transparent toner amount per unit area in the gloss-adjustment area based on the obtained information is increased.

2. A controlling apparatus according to claim 1, wherein said image data generating portion generates the image data so that the transparent toner amount per unit area in the gloss-adjustment area is increased by the predetermined amount.

3. A controlling apparatus according to claim 1, wherein in a case that the transparent toner amount per unit area in the first part of the gloss-adjustment area based on the obtained information is not larger than the lower limit amount, and the transparent toner amount per unit area in the second part of the gloss-adjustment area based on the obtained information is larger than the lower limit amount, said image data generating portion generates the image data so that the transparent toner amount per unit area in the first and second parts of the gloss-adjustment area is increased by the predetermined amount.

4. A controlling method for controlling a transparent toner image forming apparatus which forms transparent toner image on a color toner image fixed on a sheet and then heat-fixes the transparent toner image on the sheet, said controlling method, comprising:

a first step of obtaining information corresponding to a gloss-adjustment area where a gloss of the color toner image on the sheet is to be partially adjusted;

a second step of obtaining information corresponding to a transparent toner amount per unit area in the gloss-adjustment area;

a third step of generating image data for forming the transparent toner image based on the obtained information in said first step so that the transparent toner amount per unit area in an area excluding the gloss-adjustment area within an image formable area of the sheet is a predetermined amount; and a fourth step of generating image data for forming the transparent toner image based on the obtained information in said second step so that the transparent toner amount per unit area in the gloss-adjustment area based on the obtained information in said second step is increased, in a case that the transparent toner amount per unit area in the gloss-adjustment area based on the obtained information in said second step is not larger than a lower limit amount.

5. A controlling method according to claim 4, wherein the image data is generated in said fourth step so that the transparent toner amount per unit area in the gloss-adjustment area is increased by the predetermined amount.

6. A controlling method according to claim 4, wherein in a case that the transparent toner amount per unit area in the first part of the gloss-adjustment area based on the obtained information in said second step is not larger than the lower limit amount, and the transparent toner amount per unit area in the second part of the gloss-adjustment area based on the obtained information in said second step is larger than the lower limit amount, the image data is generated so that the transparent toner amount per unit area in the first and second one of the gloss-adjustment area based on the obtained information in said second step is increased by the predetermined amount in said fourth step.

* * * * *